US006689522B2

(12) United States Patent
Yamazaki et al.

(10) Patent No.: US 6,689,522 B2
(45) Date of Patent: Feb. 10, 2004

(54) IMAGE FORMING METHOD AND ELECTROSTATIC IMAGE DEVELOPING TONER

(75) Inventors: Hiroshi Yamazaki, Hachioji (JP); Ken Ohmura, Hachioji (JP); Akihiko Itami, Hachioji (JP); Meizo Shirose, Hachioji (JP); Asao Matsushima, Hachioji (JP); Hiroyuki Kozuru, Hino (JP); Tomoko Tanma, Hino (JP)

(73) Assignee: Konica Minolta Technosearch Co., Ltd., Tokyo (JP)

( * ) Notice: Subject to any disclaimer, the term of this patent is extended or adjusted under 35 U.S.C. 154(b) by 73 days.

(21) Appl. No.: 10/126,255

(22) Filed: Apr. 19, 2002

(65) Prior Publication Data

US 2003/0054269 A1 Mar. 20, 2003

(30) Foreign Application Priority Data

Apr. 26, 2001 (JP) ..... 2001-129282
Sep. 25, 2001 (JP) ..... 2001-291111

(51) Int. Cl.[7] ..... G03G 13/01
(52) U.S. Cl. ..... 430/45; 430/110.4
(58) Field of Search ..... 430/45, 110.4

(56) References Cited

U.S. PATENT DOCUMENTS 5,328,792 A * 7/1994 Shigemori et al. ..... 430/110.3
5,985,502 A * 11/1999 Ayaki et al. ..... 430/109.3
2001/0031415 A1 * 10/2001 Ito ..... 430/108.6
2002/0025184 A1 * 2/2002 Ishikawa et al. ..... 399/111
2003/0157421 A1 * 8/2003 Matsushima et al. ..... 430/124

* cited by examiner

*Primary Examiner*—Mark A. Chapman
(74) *Attorney, Agent, or Firm*—Squire, Sanders & Dempsey, L.L.P.

(57) ABSTRACT

An image forming method, comprising steps of: forming a latent image on a photoreceptor having an electrically conductive support having thereon a charge generating layer and a charge transporting layer; developing the latent image with a developer containing a toner to form a toner image on the photoreceptor; and transferring the toner image onto an image receiving member, wherein the ratio of 50% volume particle diameter to 50% number particle diameter of the toner is within the range of 1.0 to 1.15, the ratio of the cumulative 75% volume particle diameter from the largest particle diameter to the cumulative 75% number particle diameter from the largest particle diameter of the toner is 1.0 to 1.20 and the number of toner particles having a particle diameter of not larger than 0.7× Dp50 is at most 10% of the number of all the toner particles in the toner.

12 Claims, 4 Drawing Sheets

FIG. 1 - ( 1 )
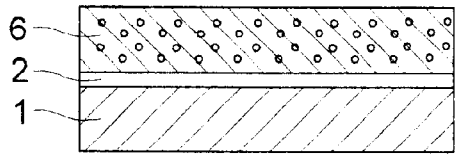
FIG. 1 - ( 4 )
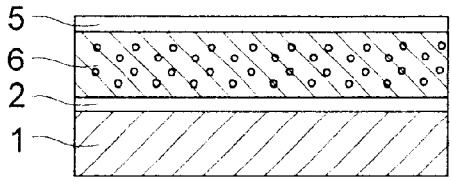
FIG. 1 - ( 2 )
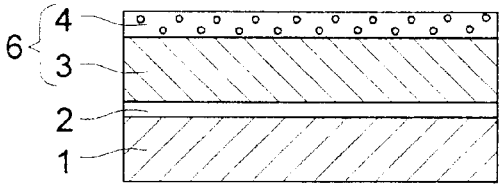
FIG. 1 - ( 5 )
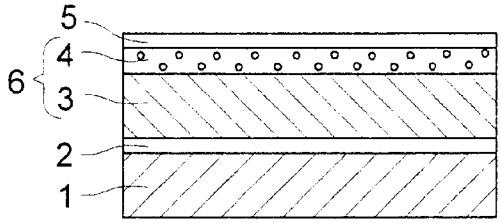
FIG. 1 - ( 3 )
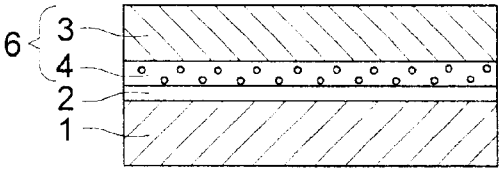
FIG. 1 - ( 6 )
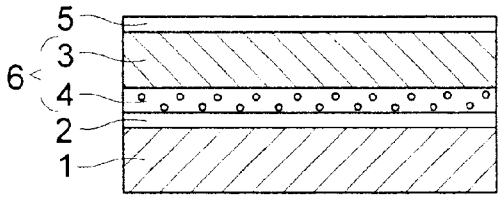

IMAGE FORMING METHOD AND ELECTROSTATIC IMAGE DEVELOPING TONER

FIELD OF THE INVENTION

The invention relates to an image forming method in which a latent image, formed on a photoreceptor, is visualized employing a developer, comprising an electrostatic image developing toner.

BACKGROUND OF THE INVENTION

An electrostatic latent image developing method, mainly based on the electrophotographic system, which has been employed in copiers and printers, is employed in the image forming apparatus, which is required for high speed as well as high quality images. Listed as additional reasons, other than the advantages described above, is the fact that high image quality is consistently obtained during use over an extended period of time, and it is also possible to form color images.

Many electrostatic latent image developing methods (hereinafter occasionally referred to as an electrophotographic method, since most of them depend upon the electrophotographic system) have been developed to achieve specific purposes, and exhibit specific features of each. While taking advantage of said features, an optimal method is selected and applied to each use. Of these, common requirements are further improvement of image quality as well as durability, and saving of resources, non-pollution, and lowered cost.

Of electrostatic latent image developing methods, a one-component non-magnetic developing method is preferred as a simple and convenient method due to fact that no density adjusting mechanism is required, and is often employed in image forming apparatus such as relatively small-sized printers as well as facsimile machines.

On the other hand, a two-component magnetic developing method is a system in which a carrier and a toner are blended, and overall dimensions of the resultant apparatus tend to increase somewhat. However, images are stably formed due to the function-separating structure of the charge application, and currently, it is the one most widely employed.

In any of these, in order to achieve higher image quality, it is effective to decrease the diameter of toner particles. In the recent trend of digitization, importance of toner comprised of particles having a small diameter (hereinafter referred also as the small-diameter toner) is increasingly elevated to form high quality images. Further, from the viewpoint of saving of resources, non-environmental pollution, and a decrease in image forming cost, a recycling system is useful in which toner, which has been recovered from a photoreceptor by cleaning, is reused.

However, when toner comprised of particles having a decreased diameter is employed in the conventional image forming systems described above, said toner particles tend to be affected by such as mechanical stress in the development unit. During development employing a single non-magnetic component developer, the toner particles are subjected to stress during formation of a thin layer in the toner conveying system, as well as stress such as shearing stress during cleaning in the toner recycling system and its conveying system. On the other hand, when a double component developer is employed, the contained carrier is stained.

As a result, when the small-diameter toner is employed over an extended period of time, it has been extremely difficult to achieve consistent development due to occurrence of various image problems.

In addition, when the small-diameter toner is employed, cleaning properties tend to be degraded. Further, when color toner is employed, problems have been noted in which the color difference between the initial image and images after a long production run tend to increase.

SUMMARY OF THE INVENTION

An object of the invention is to provide an image forming method, which results in high quality copies, and exhibits excellent cleaning properties as well as minimal color difference between the initial image and images after a long production run.

The aforesaid object of the invention was achieved by following Structures.

[Structure 1]

An image forming method, comprising the steps of:

forming a latent image on a photoreceptor having an electrically conductive support having thereon a charge generating layer and a charge transporting layer;

developing the latent image with a developer containing a toner so as to form a toner image on the photoreceptor; and transferring the toner image from the photoreceptor onto an image receiving member, wherein the ratio (Dv50/Dp50) of 50% volume particle diameter of the toner (Dv50) to 50% number particle diameter of the toner (Dp50) is within the range of 1.0 to 1.15, the ratio (Dv75/Dp75) of the cumulative 75% volume particle diameter from the largest particle diameter of the toner (Dv75) to the cumulative 75% number particle diameter from the largest particle diameter of the toner (Dp75) is within the range of 1.0 to 1.20 and the number of toner particles having a particle diameter of not larger than 0.7× Dp50 in the toner is at most 10% of the number of all the toner particles in the toner.

[Structure 2]

An image forming method comprising the steps of:

forming a latent image on a photoreceptor having an electrically conductive support having thereon a charge generating layer and a charge transporting layer;

developing the latent image with a developer containing toner so as to form a toner image on the photoreceptor;

transferring the toner image from the photoreceptor onto an intermediate image receiving member; and transferring the toner image from the intermadiate image receiving member onto an image receiving member, wherein the ratio (Dv50/Dp50) of 50% volume particle diameter of the toner (Dv50) to 50% number particle diameter of the toner (Dp50) is within the range of 1.0 to 1.15, the ratio (Dv75/Dp75) of the cumulative 75% volume particle diameter from the largest particle diameter of the toner (Dv75) to the cumulative 75% number particle diameter from the largest particle diameter (Dp75) is within the range of 1.0 to 1.20 and the number of toner particles having a particle diameter of not more than 0.7×Dp50 in the toner is at most 10% of the number of all the toner particles in the toner.

[Structure 3]

A color image forming method, comprising the steps of:

forming plural latent images separately on plural photoreceptors, each of which comprises an electrically conductive support having thereon a charge generating layer and a charge transporting layer;

developing the plural latent images with plural different color developers so as to form plural toner images on the plural photoreceptors, the plural different color developers containing plural different color toners from each other;

superimposing the plural different color toner images by transferring the plural different color toner images one after on other from the plural photoreceptors onto an intermediate image receiving member so that a color image is formed on the intermediate image receiving member; and transferring the color image is formed from the intermediate image receiving member onto an image receiving member, wherein the following relations are satisfied in at least one of the color toners: the ratio (Dv50/Dp50) of 50% volume particle diameter of the toner (Dv50) to 50% number particle diameter of at least one of the toners (Dp50) is within the range of 1.0 to 1.15, the ratio (Dv75/Dp75) of the cumulative 75% volume particle diameter from the largest particle diameter (Dv75) to the cumulative 75% number particle diameter from the largest particle diameter (Dp75) is within the range of 1.0 to 1.20 and the number of toner particles having a particle diameter of not larger than 0.7×Dp50 in the toner is at most 10% of the number of all the toner particles in the toner.

[Structure 4]

An electrostatic image developing toner, wherein the ratio (Dv50/Dp50) of 50% volume particle diameter of the toner (Dv50), to 50% number particle diameter of the toner (Dp50), is within the range of 1.0 to 1.15, the ratio (Dv75/Dp75) of the cumulative 75% volume particle diameter from the largest particle diameter of the toner (Dv75) to the cumulative 75% number particle diameter from the largest particle diameter of the toner (Dp75) is within the range of 1.0 to 1.20 and the number of toner particles having a particle diameter of not larger than 0.7× Dp50 in the toner is at most 10% of the number of all the toner particles in the toner.

BRIEF DESCRIPTION OF THE DRAWINGS

FIGS. 1(1) through 1(6) each is a schematic cross-sectional view showing one embodiment of the photoreceptor employed in the invention;

DETAILED DESCRIPTION OF THE INVENTION

Figure 2:
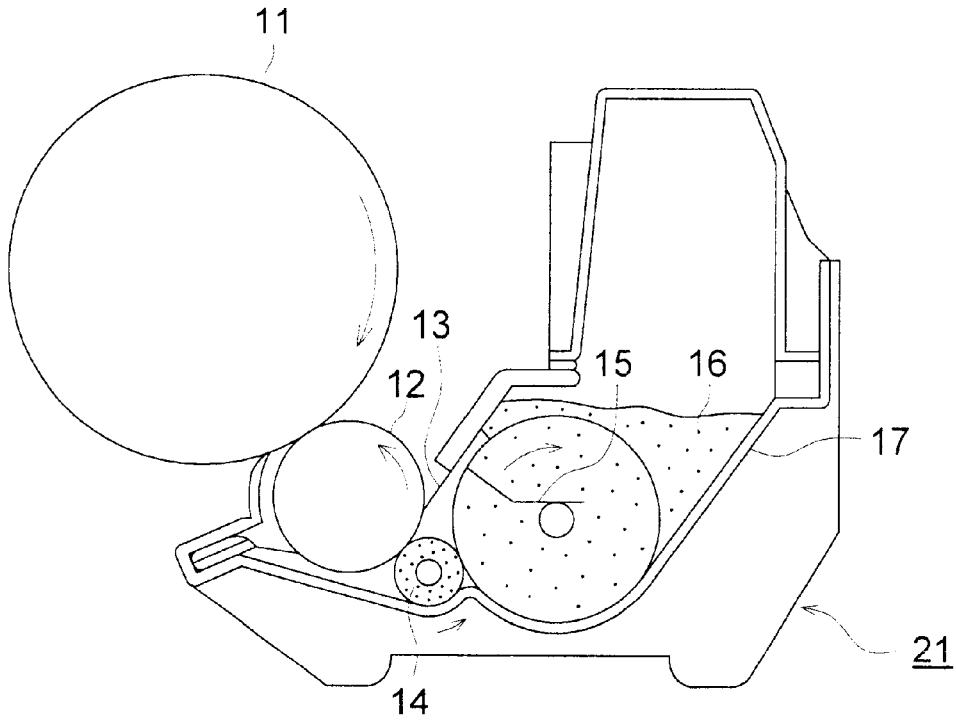
FIG. 2 is a schematic cross-sectional view of a development unit employed in the image forming method of the invention.

The invention will now be detailed.

The inventor of the invention diligently conducted investigations to solve some problems of the conventional image forming methods, known in the art, which employ toners comprised of particles having a decreased diameter (in the invention, a toner comprised of particles having a diameter of 2 to 10 $\mu$m is called a small-diameter toner). As a result, it was discovered that in toner comprised of particles having a decreased diameter, the adhesion amount as well as transferability tended to differ among particles, and further, said toner tended to be markedly affected by the electric charge on the photoreceptor.

Further, in the small-diameter toner, it was discovered that as the particle diameter decreased, developability difference as well as the adhered amount among particles increased. The mechanism which results in said phenomena has not yet been clarified. However, in the case of a toner comprised of particles having a greater diameter, adhesion force difference of each toner particle onto the photoreceptor does not increase. However, as the particle diameter decreases, it is assumed that the inherent adhesion force of said toner to the photoreceptor increases, whereby the resultant difference among toner particles increased.

In order to overcome these drawbacks, the inventors of the invention paid attention to the toner particle size distribution. Thus, the invention has been achieved.

Specifically, instead of decreasing the existing amount of the component comprised of particles having a small diameter, which increases adhesion force, the inventors of the invention pays attention to the 50 percent particle diameter, which is the median of the toner particle diameter of the entire toner. When said component comprised of particles having a smaller diameter, which deviated from said 50% particle diameter, is analyzed, the particle diameter of a cumulative of 75 percent volume particle diameter from the largest particle diameter side, as well as a cumulative of 75 percent number particle diameter from the largest particle diameter side, has been noticed. Then, said inventors conducted various investigations. As a result, the invention has been completed employing the image forming method in which, as described in Structure 1, adjustments is carried out in such a manner that the ratio (Dv50/Dp50) of the 50 percent volume particle diameter (Dv50) to the 50 percent number particle diameter (Dp50) of at least one of said toners is from 1.0 to 1.15; the ratio (Dv75/Dp75) of cumulative 75 percent volume particle diameter (Dv75) from the largest particle diameter of said toner to the cumulative 75 percent number particle diameter (Dp75) from the largest particle diameter of said toner is from 1.0 to 1.20; and the ratio of toner particles having a number particle diameter of less than or equal to 0.7×(Dp50) in the total toner, is 10 percent by number or less.

The electrostatic image developing toner (hereinafter referred simply to as the toner) according to the invention will now be described.

First, the volume particle diameter, the number particle diameter, and the ratio of said volume particle diameter to said number particle diameter, will be described.

From the viewpoint of obtaining the effects described in the invention, the toner according to the invention is preferably monodispersed in terms of particle size distribution. Further, it is required that the ratio (Dv50/Dp50) of the 50 percent volume particle diameter (Dv50) to the 50 percent number particle diameter (Dp50) of the toner is from 1.0 to 1.15. Said ratio is preferably from 1.0 to 1.13.

Further, in order to control the variation range of transferability as well as developability, the ratio (Dv75/Dp75) of the cumulative 75 percent volume particle diameter (Dv75) from the largest particle diameter to the cumulative 75 percent number particle diameter (Dp75) from the largest particle diameter is required to be from 1.0 to 1.20, and is preferably from 1.1 to 1.19. In addition, the ratio of toner particles having a number particle diameter of less than or equal to 0.7×(Dp50) is required to be 10 percent by number or less based on the total number of toner particles, and is preferably from 5 to 9 percent by number.

The 50 percent volume particle diameter (Dv50) of the toner according to the invention is preferably from 2 to 8 μm, and is more preferably from 3 to 7 μm. Further, the 50 percent number particle diameter of the toner according to the invention is preferably from 2 to 7.5 μm, and is more preferably from 2.5 to 7 μm. By adjusting said diameter to said range, the effects of the preset invention are more markedly exhibited.

Further, in the invention, when a plurality of toners is employed, it is required that at least one of the toners, but it is preferable that all the toners, satisfy the aforesaid requirements, namely the ratio (Dv50/Dp50) of the 50 percent volume particle diameter (Dv50) to the 50 percent number particle diameter (Dp50) is from 1.0 to 1.15; the ratio (Dv75/Dp75) of cumulative 75 percent volume particle diameter (Dv75) from the largest particle diameter of toner to the cumulative 75 percent number particle diameter (Dp75) from the largest particle diameter of said toner is from 1.0 to 1.20; the ratio of toner particles having a number particle diameter of less than or equal to 0.7×(Dp50), is 10 percent by number or less, based on the total number of toner particles.

The cumulative 75 percent volume particle diameter (Dv75) or the cumulative 75 percent number particle diameter (Dp75), as described herein, refers to the volume particle diameter or the number particle diameter, each of which is 75 percent with respect to the sum of the total volume or the sum of the total number while accumulating the frequency from the largest particle diameter.

In the invention, said 50 percent volume particle diameter (Dv50), 50 percent number particle diameter (Dp50), cumulative 75 percent volume diameter (Dv75), and cumulative 75 percent number particle diameter can be determined employing a Coulter Counter Type TA-II or a Coulter Multisizer (both manufactured by Coulter Co.).

The components of the electrostatic image developing toner and the components of binding resins which constitute said toner according to the invention, as well as those of these production, will now be described.

The toner according to the invention comprises at least a coloring agent as well as a binding resin. Said toner may be produced employing processes such as pulverization and classification, or employing a so-called polymerization method in which toner is prepared employing resinous particles prepared by polymerizing polymerizable monomers as described below. When said toner is prepared employing said polymerization method, a production method is particularly preferred which comprises a process in which resinous particles are subjected to salting-out/fusion.

Polymerizable monomers employed in the polymerization method comprise radical polymerizable monomers as a component, and if desired, crosslinking agents may be employed. Further, it is preferable that at least one of said radical polymerizable monomers, having an acidic group or a basic group shown below, is incorporated.

(1) Radical Polymerizable Monomers

Radical polymerizable monomer components are not particularly limited and several of the conventional radical polymerizable monomers may be employed. They may be used individually or in combination so as to satisfy the desired characteristics.

Specifically listed are aromatic based vinyl monomers, acrylic acid ester based monomers, methacrylic acid ester based monomers, vinyl ester based monomers, vinyl ether based monomers, monoolefin based monomers, diolefin based monomers, and halogenated olefin based monomers.

Listed as aromatic based vinyl monomers are, for example, styrene based monomers and derivative thereof such as o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Listed as acrylic acid or methacrylic acid ester based monomers are methyl acrylate, ethyl acrylate, butyl acrylate, 2-ethylhexyl-acrylate, cyclohexyl acrylate, phenyl acrylate, methyl methacrylate, ethyl methacrylate, butyl methacrylate, hexyl methacrylate, 2-methylphenyl methacrylate, ethyl β-hydroxyacrylate, propyl γ-aminoacrylate, stearyl methacrylate, dimethylaminoethyl methacrylate, and diethylaminoethyl methacrylate.

Listed as vinyl ester based monomers are vinyl acetate, vinyl propionate, and vinyl benzoate.

Listed as vinyl ether based monomers are vinyl methyl ether, vinyl ethyl ether, vinyl isobutyl ether, and vinyl phenyl ether.

Listed as monoolefin based monomers are ethylene, propylene, isobutylene, 1-butene, 1-pentene, and 4-methyl-1-pentene.

Listed as diolefin based monomers are butadiene, isoprene, and chloroprene.

Listed as halogenated olefin based monomers are vinyl chloride, vinylidene chloride, and vinyl bromide.

(2) Crosslinking Agents

In order to improve the characteristics of toner, as added crosslinking agents are radical polymerizable crosslinking agents. Listed as crosslinking agents are those having at least two unsaturated bonds such as divinylbenzene, divinylnaphthalene, divinyl ether, diethylene glycol methacrylate, ethylene glycol dimethacrylate, polyethylene glycol dimethacrylate, and diallyl phthalate.

(3) Polymerizable Monomers Having an Acidic Group or a Basic Group

Listed as polymerizable monomers having an acidic group or a basic group are, for example, polymerizable monomers having a carboxyl group, polymerizable monomers having a sulfonic acid group, and primary amine, secondary amine, tertiary amine and quaternary amine based polymerizable monomers.

Listed as polymerizable monomers having a carboxyl group are acrylic acid, methacrylic acid, fumaric acid, maleic acid, itaconic acid, cinnamic acid, monobutyl maleate, and monooctyl maleate.

Listed as polymerizable monomers having a sulfonic acid group are styrenesulfonic acid, allylsulfosuccinic acid, and octyl allyl sulfosuccinate.

These compounds may have a structure of salts of alkali such as sodium and potassium, or salts of alkali earth metals such as calcium.

Listed as radical polymerizable monomers having a basic group are amine based compounds which may include dimethylaminoethyl acrylate, dimethylaminoethyl methacrylate, diethylaminoethyl acrylate, diethylaminoethyl methacrylate, and quaternary ammonium salts of the 4 compounds described above; and 3-diethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; vinylpyridine, vinylpyrrolidone; vinyl N-methylpyridinium chloride, vinyl N-ethylpyridium chloride, N,Ndiallylmethylammonium chloride, and N,N-diallylethylammonium chloride.

Regarding the radical polymerizable monomers employed in the invention, the radical polymerizable monomers having an acidic group or a basic group are preferably employed in an amount of 0.1 to 15 percent by weight based on the total of said monomers. Radical polymerizable crosslinking agents are preferably employed in an amount of 0.1 to 10 percent by weight based on the total radical polymerizable monomers, even though said amount may vary depending on their characteristics.

(Chain Transfer Agents)

With the purpose of adjusting the molecular weight, commonly employed chain transfer agents may be used. Chain transfer agents are not particularly limited, and for example, octylmercaptan, dodecylmercaptan, tert-dodecylmercaptan, n-octyl-3-mercaptopropionic acid ester, carbon tetrabromide, and styrene dimer, may be employed.

(Polymerization Initiators)

Radical polymerization initiators, employed in the invention, when they are water-soluble, may be suitably employed. Listed as said initiators are, for example, persulfate salts (potassium persulfate and ammonium persulfate), azo based compounds (4,4'-azobis-4-cyanovaleric acid and salts thereof, and 2,2-azobis(2-aminodipropane) salts), and peroxides.

Further, if desired, said radical polymerization initiators may be combined with reducing agents and used as redox based initiators. By employing said redox based initiators, polymerization activity increases whereby it is possible to lower polymerization temperature and a decrease in polymerization time can be expected.

Selected as said polymerization temperature may be any reasonable temperature, as long as it is higher than or equal to the lowest radical forming temperature. For example, the temperature range of 50 to 90° C. is employed. However, when polymerization initiators, which work at normal temperature are employed in combination, such as a combination of hydrogen peroxide and a reducing agent (ascorbic acid), it is possible to carry our polymerization at temperature equal to or higher than room temperature.

(Surface Active Agents)

In order to carry out polymerization while using said radical polymerizable monomers, it is necessary to carry out oil droplet dispersion into a water-based medium, employing surface active agents. Surface active agents, which can be employed during said dispersion, are not particularly limited. Listed as suitable examples may be the ionic surface active agents shown below.

Listed as ionic surface active agents are sulfonates (sodium dodecylbenzenesulfonate, sodium arylalkyl polyether sulfonate, sodium 3,3-disulfonediphenyurea-4,4-diazo-bis-amino-8-naphthol-6-sulfonate, and sodium ortho-carboxybenzene-azo-dimethylaniline-2,2,5,5-tetramethyltriphenylmathane-4,4-diazo-bis-β-naphthol-6-sulfonate), sulfate esters (sodium dodecylsulfate, sodium tetradecylsulfate, sodium pentadecylsulfate, and sodium octylsulfate), and fatty acid salts (sodium oleate, sodium laurate, sodium caprate, sodium caprylate, sodium caproate, potassium stearate, and calcium oleate).

Further, nonionic surface active agents can also be employed. Specifically listed as such are polyethylene oxide, and polypropylene oxide, a combination of polypropylene oxide with polyethylene oxide, esters of polyethylene glycol with higher fatty acids, alkylphenol polyethylene oxide., esters of polyethylene glycol with higher fatty acid, and esters of polypropylene oxide with higher fatty acids.

In the invention, these are mainly employed as an emulsifier during emulsion polymerization, but may be employed in other processes or to achieve other purposes.

(Coloring Agents)

Listed as coloring agents may be inorganic pigments, organic pigments and dyes.

Employed as said inorganic pigments may be any of the several conventional ones known in the art. Specific inorganic pigments will be exemplified below.

Employed as black pigments may be, for example, carbon blacks such as furnace black, channel black, acetylene black, thermal black, and lamp black, and in addition magnetic powders such as magnetite and ferrite.

If desired, these inorganic pigments may be employed individually or in combination. Further, the content of said pigments is from 2 to 20 percent by weight with respect to the weight of polymers, and is preferably from 3 to 15 percent by weight.

When said inorganic pigments are employed as magnetic toner, it is possible to add said magnetite. In this case, from the viewpoint of providing the specified magnetic characteristics, said magnetite is preferably added to toner in an amount of 20 to 60 percent by weight.

Employed as said organic pigments as well as said dyes may be any of the several conventional ones known in the art. Specific organic pigments as well as specific dyes will be exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, and C.I. Pigment Yellow 156.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Employed as dyes may be C.I. Solvent Red 1, C.I. Solvent Red 49, C.I. Solvent Red 52, C.I. Solvent Red 58, C.I. Solvent Red 63, C.I. Solvent Red 111, and C.I. Solvent Red 122; C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, and C.I. and Solvent Yellow 162; C.I. Solvent Blue 25, C.I. Solvent Blue 36, C.I. Solvent Blue 60, C.I. Solvent Blue 70, C.I. Solvent Blue 93, and C.I. Solvent Blue 95, and these may be employed in combination.

If desired, these organic pigments and dyes may be employed individually or in combination of a plurality of these. The amount of pigments added is commonly from 2 to 20 percent by weight with respect to the weight of polymers, and is preferably from 3 to 15 percent by weight.

Said coloring agents may be subjected to surface modification and subsequently employed. Employed as surface modifying agents may be conventional ones known in the art. Specifically, silane coupling agents, titanium coupling agents, and aluminum coupling agents may be preferably employed.

Toner according to the invention may be employed in combination with releasing agents. For example, employed as releasing agents may be low molecular weight polyolefin waxes such as polypropylene and polyethylene, paraffin waxes, Fischer-Tropsh waxes, and ester waxes. Further, in the invention, ester waxes, represented by General Formula (1) given below, may be preferably employed.

General Formula (1)

$$R_1—(OCO—R_2)_n$$

wherein n represents an integer of 1 to 4, is preferably from 2 to 4, is more preferably from 3 to 4, and is most preferably 4;

$R_1$ and $R_2$ each represents a hydrocarbon group which may have a substituent; $R_1$ has from 1 to 40 carbon atoms, preferably has from 1 to 20 carbons atoms, and more preferably has from 2 to 5 carbons atoms; $R_2$ has from 1 to 40 carbon atoms, preferably has from 13 to 29 carbons atoms, and more preferably from 12 to 25 carbon atoms.

Specific examples of crystalline compounds, having an ester group according to the invention, are shown below. However, the invention is not limited to these examples.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10)
$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)
$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)
$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

-continued

13)
$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)
$$\begin{array}{l} CH_2—OH \\ | \\ CH—OH \\ | \\ CH_2—O—CO—(CH_2)_{26}—CH_3 \end{array}$$

15)
$$\begin{array}{l} CH_2—OH \\ | \\ CH—OH \\ | \\ CH_2—O—CO—(CH_2)_{22}—CH_3 \end{array}$$

16)
$$CH_3—(CH_2)_{26}—COO—CH_2—C(CH_3)(CH_2—O—CO—(CH_2)_{26}—CH_3)_2$$

17)
$$CH_3—(CH_2)_{20}—COO—CH_2—C(CH_2CH_3)(CH_2—O—CO—(CH_2)_{20}—CH_3)_2$$

18)
$$CH_3—(CH_2)_{26}—COO—CH_2—C(CH_2—O—CO—(CH_2)_{26}—CH_3)_3$$

19)
$$CH_3—(CH_2)_{20}—COO—CH_2—C(CH_2—O—CO—(CH_2)_{20}—CH_3)_3$$

20)
$$CH_3—(CH_2)_{18}—COO—CH_2—C(CH_2—O—CO—(CH_2)_{18}—CH_3)_3$$

21)
$$CH_3—(CH_2)_{16}—COO—CH_2—C(CH_2—O—CO—(CH_2)_{16}—CH_3)_3$$

22)
$$CH_3—(CH_2)_{20}—COO—CH_2—C(CH_2—O—CO—CH_3)_3$$

These ester waxes are incorporated into resinous particles and function to provide excellent fixability (adhesion properties to the image receiving member) to the toner which has been prepared by fusing resinous particles.

The content ratio of releasing agents employed in the invention is preferably from 1 to 30 percent by weight, based on the weight of all the toners, is more preferably from 2 to 20 percent by weight, and is further more preferably from 3 to 15 percent by weight. Further, the preferred toner of the invention is prepared as described below. Said releasing agents are dissolved in the aforesaid polymerizable monomers, and the resultant solution is dispersed into water.

Subsequently, the resultant dispersion undergoes polymerization, and particles are formed in which the ester based compounds, described above as a releasing agent, are incorporated in the resinous particles. Subsequently, said toner is prepared through a process in which the resultant particles are salted out/fused together with said coloring agent particles.

In addition to said coloring agents and releasing agents, materials, which can provide various functions, may be added as toner materials to the toner according to the invention. Specifically, listed are charge control agents. These components may be added employing various methods such a method in which during the stage of said salting-out/fusion, said components are simultaneously added with said resinous particles as well as said coloring agents so that said components are included in toner particles, and a method in which said components are directly added to said resinous particles.

In the same manner, it is possible to employ various charge control agents, known in the art, and can be dispersed into water. Listed as specific examples are nigrosine based dyes, metal salts of naphthenic acid or higher fatty acids, alkoxylated amines, quaternary ammonium salts, azo based metal complexes, metal salicylates or metal complexes thereof.

External agents employed in the toner according to the invention will now be described.

For the purpose of improving fluidity and chargeability, as well as of enhancing cleaning properties, so-called external additives may be employed via addition to the toner according to the invention. These external additives are not particularly limited, but various fine inorganic and organic particles, as well as slipping agents can be employed.

Employed as fine inorganic particles may be any of the several conventional ones known in the art. Specifically, fine particles of silica, titanium, and alumina may be preferably employed. As said fine inorganic particles, hydrophobic ones are preferred. Listed as specific fine silica particles are commercially available products such as R-805, R-976, R-974, R-972, R-812, and R-809, manufactured by Nippon Aerosil Co.; HVK-2150 and H-200, manufactured by Hoechst Co.; and TS-720, TS-530, TS-610, H-5, and MS-5, manufactured by Cabot Co.

Listed as fine titanium particles are, for example, commerially available products such as T-805 and T-604, manufactured by Nippon Aerosil Co.; MT-100S, MT-100B, MT-500BS, MT-600, MT-600SS, and JA-1, manufactured by Teika Co.; TA-300SI, TA-500, TAF-130, TAF-510, and TAF-510T, manufactured by Fuji Titan Co.; IT-S, IT-OA, IT-OB, and IT-OC, manufactured by Idemitsu Kosan Co.

Listed as fine alumina particles are, for example, commerally available products such as RFY-C, manufactured by Nippon Aerosil Co. and TTO-55, manufactured by Ishihara Sangyo Co.

Further, employed as fine organic particles may be spherical ones having a number average primary particle diameter of about 10 to about 2,000 nm. Employed as materials for such fine organic particles may be homopolymers of styrene and methylmethacrylate and copolymers thereof.

Listed as slipping agents are, for example, salts of higher fatty acids such as salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; as well as salts of ricinolic acid with zinc and calcium.

The content ratio of these external additives is preferably from 1 to 5 percent by weight with respect to the toner.

Listed as units which are employed to add said external additives are various mixers, known in the art, such as a turbuler mixer, a Henschel mixer, a Nauter mixer, and a V type mixer.

The production method of the electrostatic image developing toner according to the invention will now be described.

<<Production Processes>>

The toner of the invention is preferably produced employing a polymerization method, comprising a process in which a polymerizable monomer solution, in which releasing agents are dissolved, or a dispersion prepared by dispersing a polymerizable monomer solution into a water-based medium undergoes polymerization so that releasing agents are incorporated into resinous particles; a washing process in which the resultant particles are collected from said water-based medium, employing filtration so that surface active agents and the like are removed; a drying process in which the resultant particles are dried; and an external additive adding process in which external additives are added to the particle prepared by drying. Herein, said resinous particles include colored particles. Said colored particles are prepared by fusing resinous particles in a water-based medium to which a coloring agent dispersion has been added.

Specifically, said fusion is preferably carried out employing a method in which resinous particles prepared by said polymerization process are subjected to salting-out/fusion. Further, when non-colored resinous particles are employed, resinous particles and coloring agent particles can be subjected to salting-out/fusion in a water-based medium.

Further, being not limited to said coloring agents and said releasing agents, charge control agents and the like may be added in the form of those particles during said process.

Incidentally, the water-based medium, as described herein, refers to a medium comprised of water as a main component in which the content ratio of water is at least 50 percent by weight. Listed as components, other than water, may be water-soluble organic solvents, and include, for example, methanol, ethanol, isopropanol, butanol, acetone, methyl ethyl ketone, and tetrahydrofuran. Of these, alcohol based organic solvents such as methanol, ethanol, isopropanol, and butanol, which preferably do not dissolve said resins, are particularly preferred.

Cited as the preferred polymerization method in the invention may be a method in which a monomer solution, prepared by dissolving releasing agents in said monomers, is dispersed, employing a mechanical device, in the form of oil droplets into a water-based medium in which surface active agents are dissolved at the critical micelle concentration or less, subsequently water-soluble polymerization initiators are added to the resultant dispersion, and the resultant mixture undergoes radical polymerization. In said polymerization, oil-soluble polymerization initiators may be added to said monomers.

Homogenizers to carry out said oil droplet dispersion are not particularly limited. Listed as such homogenizers may be, for example, Clear Mix, ultrasonic homogenizers, mechanical type homogenizers, Manton-Gaulin homogenizers, and pressure type homogenizers.

Coloring agents may be subjected to surface modification and then employed. In a surface modification method of coloring agents, said coloring agents are dispersed into solvents, and surface modifying agents are added into the resultant dispersion. The resultant mixture is then heated to result in the desired reaction. After said reaction, the resultant mixture is filtered and the filtrate is repeatedly washed and filtered employing the same solvents, and subsequently dried, whereby a pigment, which has been treated with said surface modifying agents, is obtained.

Said coloring agent particles may be prepared employing a method in which coloring agents are dispersed into a water-based medium. Said dispersion is preferably carried out in such a state that the concentration of a surface active agent in water is adjusted to its critical micelle concentration (CMC) or higher.

Homogenizers employed for dispersing pigments are not particularly limited. Listed as preferred homogenizers are Clear Mix, ultrasonic homogenizers, mechanical homogenizers, pressure homogenizers such as Manton-Gaulin and pressure type homogenizers, and medium type homogenizers such as a Getzman mill and a diamond fine mill.

Employed as surface active agents utilized herein may be those previously described.

The process, which carries out salting-out/fusion, is a process in which salting-out agents, comprised of alkali metal salts and alkali earth metal salts, is added as a coagulant, at a critical coagulation concentration or higher, to water in which resinous particles as well as coloring agent particles are present, and subsequently, the resultant mixture is heated to a temperature higher than or equal to the glass transition point of said resinous particles so that salting out and fusion proceed simultaneously.

Herein, regarding alkali metal salts and alkali earth metal salts as the salting-out agent, listed as alkali metals are lithium, potassium, and sodium, and listed as alkali earth metals are magnesium, calcium, strontium, and barium. Of these, potassium, sodium, magnesium, calcium and barium are preferably listed. Further, listed as formed salts are chloride salts, bromide salts, iodide salts, carbonate salts, and sulfate salts.

Methods to achieve the desired particle size distribution of toner are not particularly limited. However, employed may be methods utilizing classification, controlling temperature as well as time during coalescence, and in addition, selecting methods to terminate said coalescence.

Listed as the particularly preferred production method is a method to control the coalescence time, the coalescence temperature, and the termination rate in water. Namely, when salting-out/fusion is employed, it is preferable to minimize hold-over time after adding salting-out agents. The reasons have not yet been studied well enough to be fully clarified. However, problems occur in which depending on said hold-over time after adding salting-out agents, the coagulation state of particles varies, the particle size distribution fluctuates, and the surface properties of fused toner particles also varies. Temperature during addition of salting-out agents is not particularly limited.

In the invention, it is preferable to employ a method in which the dispersion of resinous particles is heated as quickly as possible so that said resinous particles are heated to a temperature higher than or equal to the glass transition point. Time required for increasing to said temperature is less than 30 minutes, and is preferably less than 10 minutes. Further, it is necessary to increase the temperature quickly and the rate of temperature increase is at least 1° C./minute. The upper limit has not yet been clarified, but from the viewpoint of retarding the formation of coarse particles due to the rapid progress of salting-out/fusion, said rate is preferably 15° C./minute or less. A particularly preferred state may be formed employing a method in which said salting-out/fusion continuously proceeds even when the temperature reaches at least the glass transition temperature. By utilizing said method, it is possible to effectively carry out fusion along with particle growth, whereby it is possible to enhance the durability of said finished toner.

Further, by carrying out said salting-out/fusion, employing divalent metal salts during coalescence, it becomes possible to specifically control the particle diameter. The reasons have not yet been studied well enough to be fully clarified. However, it is assumed that by employing said divalent metal salts, the repulsive force between particles becomes greater during salting-out, and as a result, it has become possible to control the particle size distribution.

Further, it is preferable that in order to terminate salting-out/fusion, univalent metal salts, as well as water, are added. By adding those, it is possible to terminate said salting-out. As a result, it becomes possible to control the quantity of particles having a larger diameter as well as the quantity of particles having a smaller diameter.

In a toner prepared by employing this polymerization method, which is prepared by coalescing or fusing resinous particles in water-based medium, it is possible to optionally vary the shape distribution, as well as the shape of the entire toner, by controlling the flow of the medium as well as the temperature distribution in the reaction vessel during the fusion stage, and further by controlling the heating temperature, the stirring rotation frequency, and the time during the shape controlling process after fusion.

Namely, in toner, prepared employing this polymerization method, which is prepared by coalescing or fusing resinous particles, it is possible to form toner having the shape factor as well as the uniform shape distribution of the invention, by controlling the temperature, the rotation frequency, and the time during the fusion process and the shape control process, employing stirring blades as well as a stirring vessel which make it possible to make the flow in the reaction apparatus a laminar flow, and the interior temperature distribution uniform. The reasons are assumed to be as follows. When said fusion is carried out in a field in which said laminar flow is formed, strong stress is not applied to particles (coalesced or coagulated particles) which are being subjected to coagulation and fusion. In addition, in said laminar flow in which the flow rate is accelerated, the temperature distribution in the stirring vessel is uniform. As a result, the shape distribution of particles formed through said fusion becomes uniform. Further, particles formed by fusion gradually vary into spheres due to heating and stirring following the shape control process, whereby it is possible to optionally control the shape of toner particles.

In order to adjust the toner particles of the invention to the specified shape, it is preferable to simultaneously carry out salting-out and fusion. A method, in which heating is carried out after forming coagulated particles, tends to result in non-uniform shape distribution, and in addition, cannot retard the formation of fine particles. Namely, it is assumed that coagulated particles are divided due to the fact that said coagulated particles are heated in a water-based medium while being stirred, whereby small diameter particles tend to be formed.

The developer employed in the invention will now be described.

When employed as a double component developer after blending with a carrier, employed as magnetic particles of said carrier may be any of the several conventional materials known in the art, such metals include iron, ferrite and magnetite and alloys of said metals with metals including aluminum and lead. Ferrite particles are particularly preferred. The volume average diameter of said magnetic particles is preferably from 15 to 100 $\mu$m, and is more preferably from 25 to 80 $\mu$m.

The volume average particle diameter of said carrier can be determined employing a representative apparatus such as a laser diffraction type size distribution measurement apparatus "HELOS" (manufactured by Sympatec Co.) fitted with a wet type homogenizer.

Preferred as said carrier are carriers comprised of magnetic particles further coated with resins, and a so-called resin dispersion type carrier prepared by dispersing magnetic particles into resins. Resin compositions for coating are not particularly limited. For example, employed may be olefin based resins, styrene based resins, styrene-acryl based resins, silicone based resins, ester based resins, or fluorine-containing polymer based resins. Further, resins for constituting said resin dispersion type carrier are also not particularly limited, and any of the several known in the art can be employed. For example, it is possible to employ styrene-acryl based resins, polyester resins, fluorine based resins, and phenol resins.

The photoreceptor preferably used in the invention will now be described.

The inventors of the invention then conducted investigations and discovered that it was possible to decrease the variation difference of the adhesion force of the toner to the photoreceptor by decreasing the layer thickness of the layer of the photoreceptor, especially the layer thickness of the charge transporting layer. In addition, it was discovered that it was possible to minimize the variation of the surface potential of the photoreceptor. Further, it was also discovered that it was possible to promote a uniform transferability as well as a uniform developability by employing toner according to the invention.

A photoreceptor used in the invention comprises an electrically conductive support having thereon at least a charge generating layer and a charge transporting layer, which can be prepared by laminating. From the viewpoint of minimizing the difference in dielectric constants on said photoreceptor, stabilizing developability as well as transferability of toner, and resulting in the effects of the invention, the average thickness of said charge transporting layer is adjusted to 5 to 15 $\mu$m preferably, and more preferably, is from 6 to 13 $\mu$m. Herein, the thickness of said charge transport layer can be determined employing an eddy current type layer thickness measurement instrument Eddy 560C (manufactured by Helmut Fischer GMBTE Co.) The thickness of randomly selected 10 points of the photoreceptor layer is thus measured. Then the thickness of said charge transporting layer is determined by averaging the obtained values.

Further, the thickness variation of said photoreceptor layer is preferably 2 $\mu$m or less in terms of the difference between the maximum layer thickness and the minimum layer thickness.

photoreceptors preferably employed in the invention will now be explained.

In the invention, organic photoreceptors are preferably employed as the photoreceptor. The preferred constitution of said organic photoreceptors will now be described with reverence to FIGS. 1-(1) through 1-(6).

Herein, each of FIGS. 1-(1) through 1-(6) is a schematic cross-sectional view showing one embodiment of the photoreceptor employed in the invention.

FIG. 1-(1) shows a photoreceptor comprising the electrically conductive support 1 having thereon, via interlayer 2, photosensitive layer 6 comprised of a single layer comprising both a charge generating material (CGM) and a charge transporting material (CTM);

FIG. 1-(2) shows a photoreceptor comprising an electrically conductive support 1 having thereon, via interlayer 2, photosensitive layer 6 prepared by laminating charge transporting layer (CTL) 3 comprising a charge transporting material as a main component and charge generating layer (CGL) 4 comprising a charge generating material as a main component in said order;

FIG. 1-(3) shows a photoreceptor comprising an electrically conductive support 1 having thereon, via interlayer 2, photosensitive layer 6 prepared by laminating charge generating layer (CGL) 4 comprising a charge generating material (CGM) as a main component and charger transporting layer (CTL) 3 comprising a charge transporting material as a main component in said order;

FIGS. 1-(4), 1-(5), and 1-(6) each shows the constitution in which protective layer 5 is laminated on each photosensitive layer 6 in FIGS. 1-(1) through 1-(3).

The cross-sectional views shown in FIGS. 1-(1) through 1-(6) show representative constitutions. The invention is not limited to these constitutions. Further, the interlayer shown in these constitutions is provided, if desired, whereby it may or may not be coated. Further, fine semiconductive particles such as titanium oxide may be added to said interlayer.

Further, silica and fine organic particles may be added to protective layer 5. Still further, CTM may also be added to said protective layer.

Listed as charge generating materials (CGM) employed in the photoreceptors shown in FIGS. 1-(1) through 1-(6) may be, for example, phthalocyanine pigments, polycyclic quinone pigments, azo pigments, perylene pigments, indigo pigments, quinacridone pigments, azulenium pigments, squarylium dyes, cyanine dyes, pyrylium dyes, thiopyrylium dyes, xanthene, triphenylmethane based dyes, and styryl based dyes. These may be employed individually or in combination, and are employed for layer formation together with suitable binder resins.

Listed as particularly preferred CGMs may be phthalocyanine pigments, specifically titanyl phthalocyanine type pigments in which Bragg angle 2θ, with respect to Cu—Kα rays, has a maximum peak at 27.2 degrees, and bisbenzoimidazoleperylene in which, for example, said 2θ has its maximum peak at 12.4 degrees.

Employed as binders constituting said charge transporting layer may be any of several resins known in the art. Listed as preferred resins may be formal resins, butyral resins, silicone resins, silicone modified butyral resins, and phenoxy resins. The ratio of said binder resins to said CGMs is preferably from 20 to 600 weight parts with respect to 100 weight parts of the binder resins. The thickness of said CGL layer is preferably from 0.01 to 2 $\mu$m.

Further listed as charge transporting materials (CTMs) incorporated in photosensitive layer 6 are, for example, oxazole derivatives, oxadiazole derivatives, thiazole derivatives, triazole derivatives, imidazole derivatives, imidazoline derivatives, imidazolone derivatives, bisimidazolidine derivatives, styryl based derivatives, hydrazone based derivatives, benzidine based derivatives, pyrazoline derivatives, stilbene based derivatives, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-carbazole, poly-1-vinylpyrene, and poly-9-vinylanthracene. These CTMs can generally carry out layer formation in association with binders.

Of those, listed as particularly preferred CTMS employed in the invention are triphenylaminestyryl compounds represented by General Formula (3) described below.

General Formula (3)

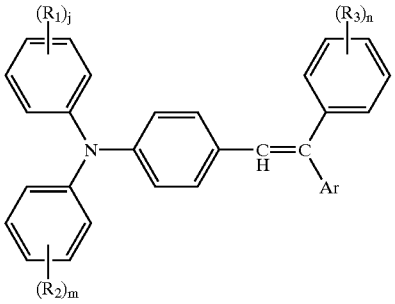

In General Formula (3), $R_1$, $R_2$, and $R_3$ each represents a hydrogen atom, a halogen atom, an alkyl group having from 1 to 5 carbon atoms, or an alkoxy group; l, m, and n each represents an integer of 0 to 3; and Ar represents a hydrogen atom or an aryl group. Said aryl group may be unsubstituted or substituted. Listed as substituents are a hydrogen atom, a halogen atom, an alkyl group having from 1 to 5 carbon atoms, or an alkoxy group. Of aryl groups, a phenyl group is particularly preferred.

Specific examples of triphenylaminestyryl compounds represented by General Formula (3) are shown below. However, the invention is not limited to these examples.

(T-1)

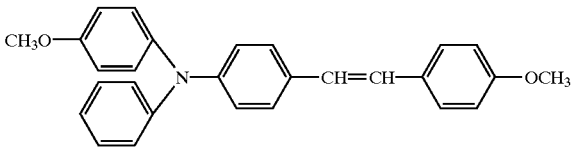

(T-2)

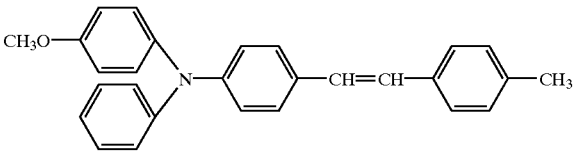

(T-3)

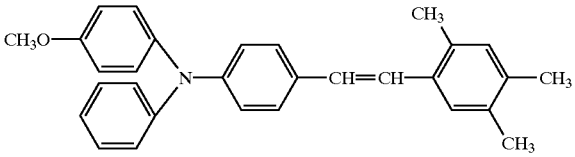

(T-4)

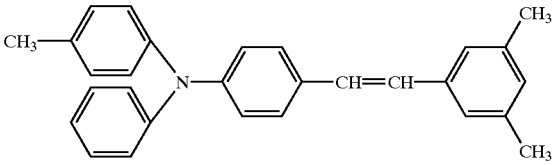

-continued (T-5)

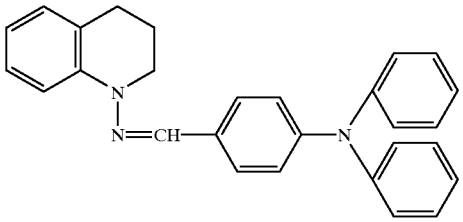

(T-6)

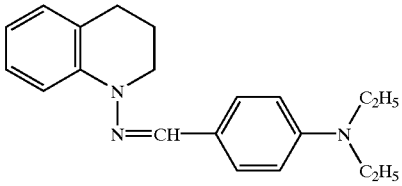

(T-7)

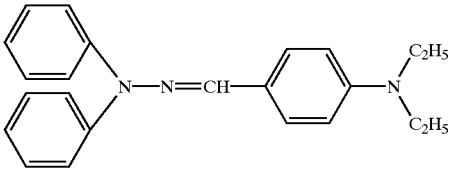

(T-8)

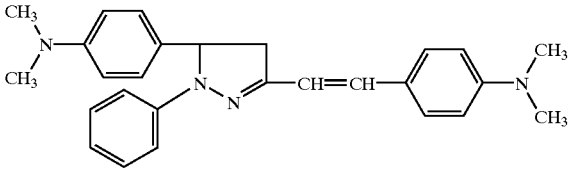

(T-9)

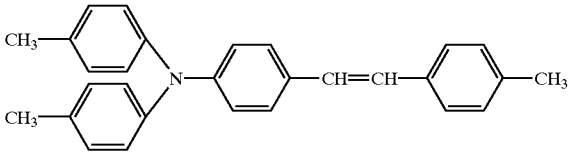

(T-10)

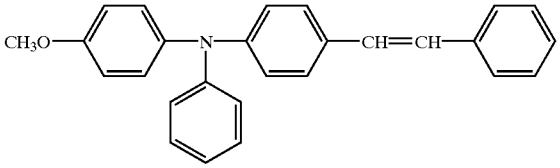

(T-11)

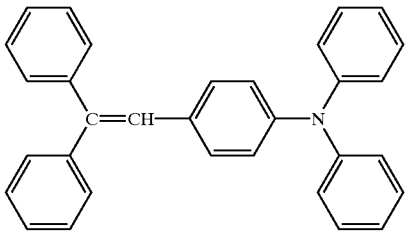

-continued
(T-12)
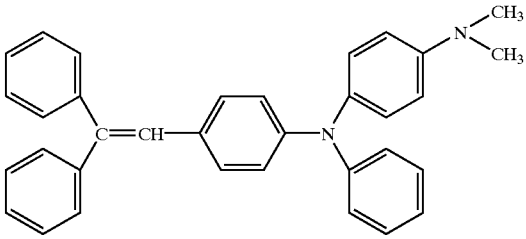
(T-13)
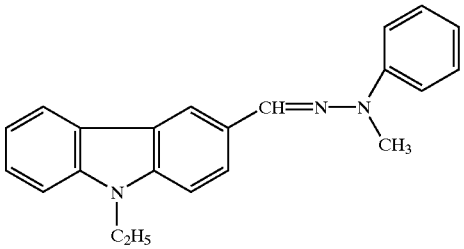
(T-14)
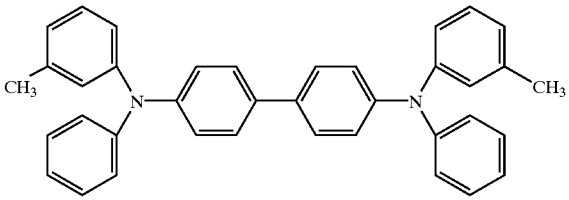
(T-15)
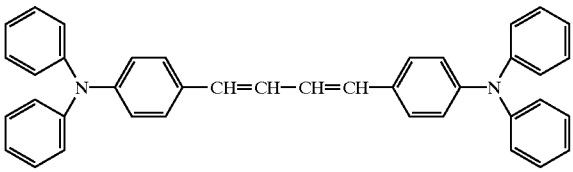
(T-16)
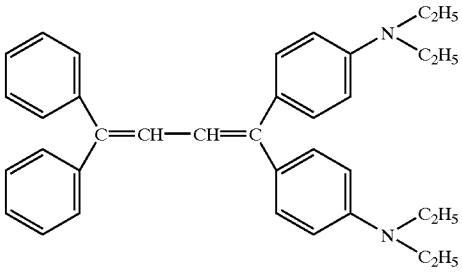
(T-17)
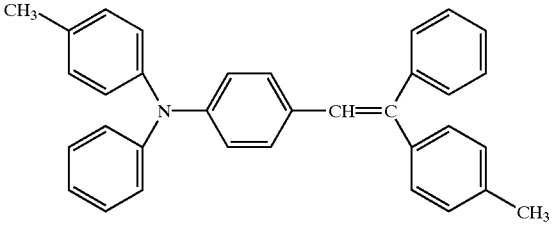
-continued
(T-18)
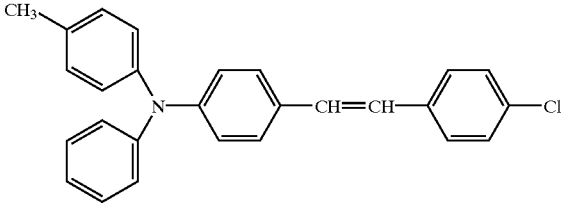
(T-19)
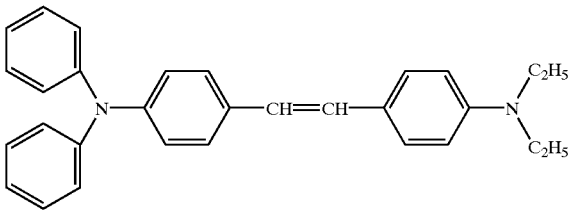
(T-20)
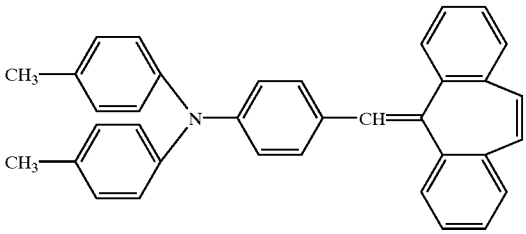
(T-21)
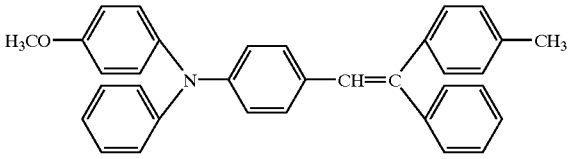
(T-22)
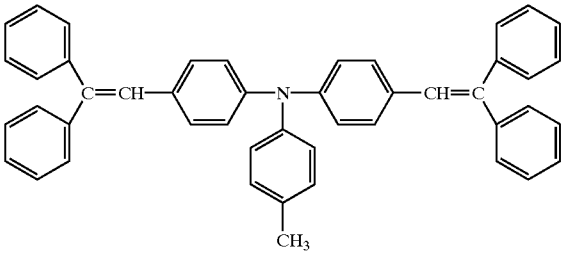
(T-23)
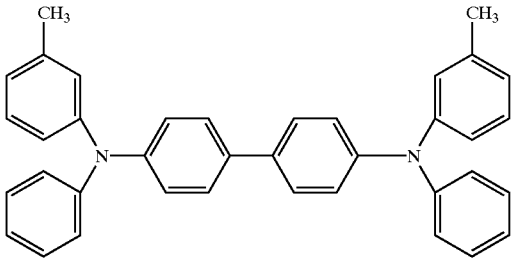

-continued (T-24)

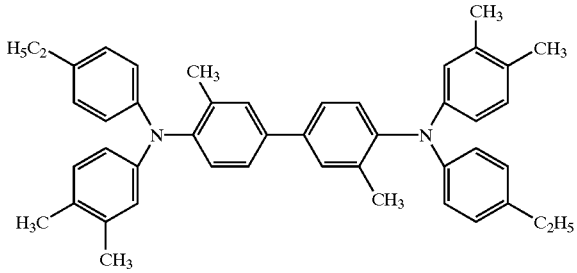

(T-25)

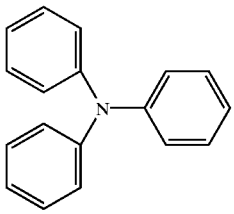

(T-26)

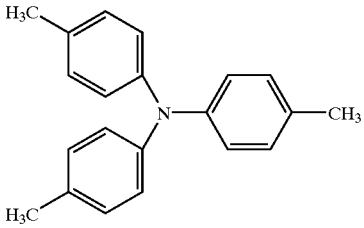

(T-27)

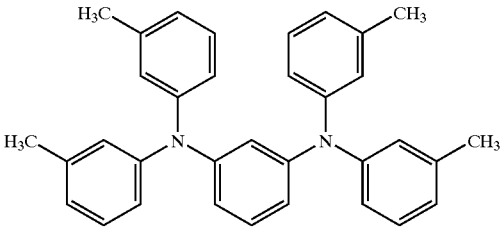

(T-28)

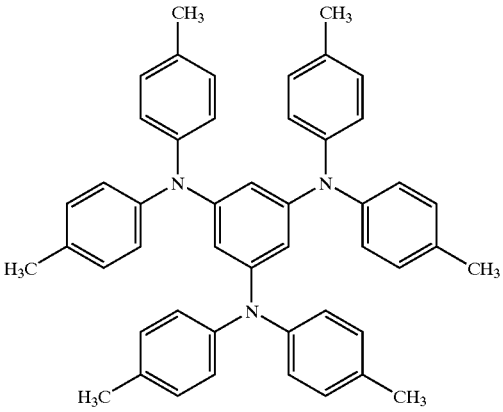

-continued (T-29)

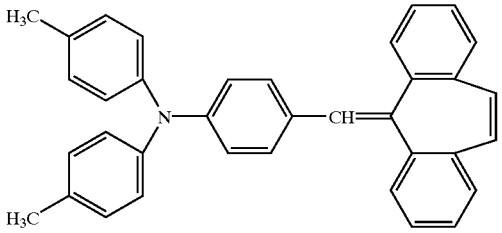

(T-30)

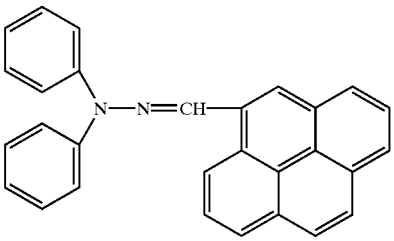

Listed as binders incorporated into said charge transporting layer (CTL) may be polycarbonate resins, polyesters, styrene based resins, acrylic resins, vinyl chloride resins, polyvinyl butyral, polyvinyl acetal, styrene-butadiene resins, urethane resins, silicone resins, and phenol resins. Listed as particularly preferred binders may be polycarbonate resins.

Said CTL is formed as follows. CTMs are dissolved in the aforesaid organic solvents and the resultant composition is coated and subsequently dried. The ratio of said CTMs to said binder resins in said CTL is preferably from 3:1 to 1:3 in terms of weight ratio.

Further, when a plurality of CTLs are formed, the molecular weight of binder resins, incorporated in the CTL formed as the uppermost layer, is preferably large. Through such layer configuration, it is possible to enhance its mechanical strength.

The molecular weight of polycarbonate resins as a binder resin, employed in the uppermost CTL, is preferably at least 50,000 in terms of viscosity average molecular weight, and is most preferably from 100,000 to 500,000. In addition, the viscosity average molecular weight of the polycarbonate resins incorporated in the CTL formed beneath the outermost layer is preferably less than that of the uppermost layer. In this case, said molecular weight is preferably in the range of less than 50,000, and is more preferably in the range of 20,000 to 40,000. Through such configuration, it is possible to enhance mechanical abrasion resistance and also possible to minimize variation of the layer thickness, even when employing a thin-layer photoreceptor.

Electrically conductive supports to constitute said photoreceptor include:

(1) conductive metals such as aluminum and stainless steel;
(2) those prepared by laminating the surface of an insulating base body, such as paper or plastic film, with conductive metals such as aluminum, palladium, and gold, or by applying said metals onto the surface of said body utilizing vacuum evaporation and;
(3) those prepared by applying or evaporating conductive compounds such as conductive polymers, indium oxide, and tin oxide onto the surface of an insulating base body such as paper or plastic film.

Coating methods to produce the photoreceptor according to the invention include dip coating, spray coating as described in Japanese Patent Publication Open to Public Inspection Nos. 3-90250 and 3-269238, and circular amount regulating type coating described in Japanese Patent Publication Open to Public Inspection No. 58-189061. Of these, said circular amount regulating type coating method is preferably employed as a method to achieve a laminated structure due to the fact that the upper layer can be coated without dissolving the lower layer.

The image forming method of the invention will now be described.

The image forming method of the invention comprises at least the steps of forming a latent image on a photoreceptor, developing step the latent image onto the photoreceptor so as to form a toner image by employing a developer containing a toner, and transferring the toner image from the photoreceptor onto an image receiving member, and ordinarily, the image forming method further comprises a fixing step, in which said toner image is fixed onto the image receiving member. Employed as said developer is developer containing the electrostatic image developing toner described in Structure 12.

The image forming method according to the invention, in which the effects of the invention are more dramatically achieved, comprises the latent image forming step, the developing step, and further the steps of transferring the toner image from the photoreceptor onto an intermediate image receiving member before transferring the toner image onto the image receiving member, and transferring the toner image from the intermadiate image receiving member onto the image receiving member.

Further, in the image forming method of the invention, a system is preferred in which latent images are developed by supplying a thin layer of non-magnetic toner to the surface of the photoreceptor (the electrostatic latent image forming member).

It is preferable that the image forming apparatus according to the image forming method of the invention be fitted with a toner conveying member, a toner layer regulating member and an auxiliary toner supply member, and in addition, said auxiliary toner supply member is to come into contact with said toner conveying member while said toner layer regulating member comes into contact with said toner conveying member.

Said toner conveying member supplies a non-magnetic toner to an electrostatic latent image forming member, such as an electrophotographic photoreceptor. From the viewpoint of assuring sufficient development region in the state of contact with the electrostatic latent image forming member, an elastic member is preferred as said toner conveying member.

In the invention, urethane rubber or silicone rubber rollers, as well as devices in which a sponge roller is placed in the interior of a conductive loop-shaped member (specifically one prepared by applying conductive materials onto the surface of a nickel or PET base), are preferably employed.

Said toner layer regulating member exhibits functions which uniformly apply toner onto said toner conveying member and in addition which provides triboelectrification. Specifically employed as said members are elastic bodies such as urethane rubber and metal panels. Said toner layer regulating member is brought into contact with said toner conveying member, whereby a thin toner layer is formed on said toner conveying member. Said thin toner layer, as described herein, refers to a layer in the state that a toner layer is comprised of at most 10 layers and preferably 5 layers or less.

Incidentally, from the viewpoint of minimizing uneven conveyance as well as minimizing formation of white streaking on images due to uneven toner conveyance, said toner layer regulating member is preferably brought into contact with said toner conveying member at a pressure of 10 mN/cm to 5 N/cm, and more preferably at a pressure of 200 mN/cm to 4 N/cm.

Said auxiliary toner supply member is a unit to uniformly supply toner to said toner supply member. Employed as said units may be water wheel-shaped rollers fitted with stirring blades or sponge-shaped rollers. In the invention, from the viewpoint of stabilizing the toner supplying and minimizing streaking image problems, the diameter of said toner supply member is preferably in the range of 0.2 to 1.5 times the diameter of said toner conveying member.

One embodiment of the development unit (being a development apparatus), which is employed for the image forming method in the invention, will now be described with specific reference to FIG. 2.

FIG. 2 is a schematic cross-sectional view of a development unit employed in the image forming method of the invention.

In FIG. 2, single non-magnetic component toner 16, stored in toner tank 17, is enforcedly convey-supplied onto sponge roller 14 as an auxiliary toner supply member, employing stirring blade 15 as said auxiliary toner supply member. Toner adhered on sponge roller 14 is conveyed onto rubber roller 12, being as a toner conveying member, utilizing the rotation in the arrowed direction of said sponge roller 14, and is electrostatically and physically adsorbed onto its surface due to friction with rubber roller 12. On the other hand, the toner adhered onto rubber roller 12, as described above, is subjected to thin uniform layering and simultaneous triboelectrification due to the rotation of rubber roller 12 in the arrowed direction, as well as flexible steel blade 13 as a toner layer thickness regulating member.

The thin toner layer formed on rubber roller 12, as above, comes into contact with or approaches the surface of electrophotographic drum (being a photoreceptor) 11, whereby a latent image is developed. However, the development unit employed in the image forming method of the invention is not limited to the one shown in FIG. 2.

Listed as a fixing method employed in the invention is a so-called contact heating system as a preferred fixing method. Further listed as said contact heating systems are a heating pressure fixing system, a heating roller fixing system, and a pressure contact heat fixing system in which fixing is carried out employing a rotating pressure member including a stationary heating body.

In many instances, said heating roller fixing system comprises an upper roller constituted in such a manner that an iron or aluminum cylinder, having a heating source in its interior, is covered with tetrafluoroethylene or polytetrafluoroethylene-perfluoroalkoxyvinyl ether copolymers, and a lower roller comprised of silicone rubber. Said fixing system comprises a linear heater as said heating source. In representative examples, the surface temperature of said upper roller is from about 120 to about 200° C. In the fixing section, said upper roller comes into pressure contact with said lower roller, and the lower roller is deformed so as to form a so-called nip. The nip width is commonly from 1 to 10 mm, and is preferably from 1.5 to 7 mm. The linear fixing rate is preferably from 40 to 60 mm/second. When said nip width is less than the lower limit, it is impossible to uniformly supply heat to the toner, resulting in uneven fixing. On the other hand, when said nip width is greater than the upper limit, fusion of resins is enhanced and problems occur in which off-setting during fixing becomes excessive.

Further, the image forming apparatus employed in the invention is preferably provided with a fixing mechanism. Employed as said fixing mechanism is a method in which silicone oil is supplied onto the upper fixing roller, or film, or a method in which cleaning is conducted employing pads, rollers or webs which have been impregnated with silicone oil. Further, a system in which fixing is carried out employing a rotating pressure member, including a stationary heating body arranged to be employed in the invention.

Said fixing system is one in which pressure contact heat fixing is carried out employing a stationary heating body as well as a pressure member which is brought into pressure contact with said heating body, and a pressure member which allows a recording material to come into close contact with the heating body via film. A fixing unit employed in said pressure contact heat fixing, comprises a heating body having a lower heat capacity than conventional heating rollers and has a linear heating section in the right direction with respect to the passage of said recording material. The maximum temperature range at the heating section is preferably adjusted from 100 to 300° C.

The image forming apparatus, employing the image forming method of the invention, which is fitted with a toner recycling mechanism, is preferably used.

Figure 3:
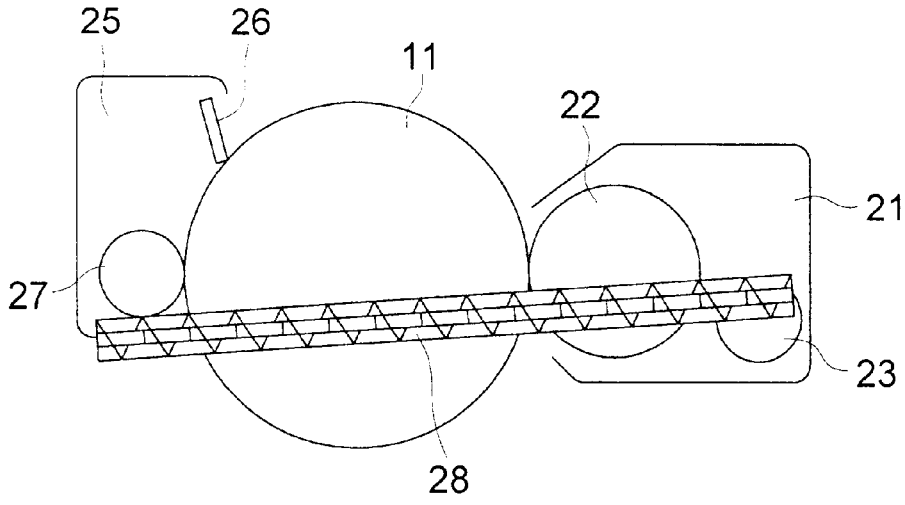
FIG. 3 is a schematic view showing one embodiment of the toner recycling unit employed in the invention.

FIG. 3 shows one embodiment of a toner recycling unit.

In FIG. 3, numeral 21 is a development unit, 22 is a developer conveying sleeve, 23 is a developer conveying screw, 11 is an electrophotographic photosensitive drum (a photoreceptor), 25 is a cleaning section, 26 is a cleaning member (being an elastic blade), 27 is a recycled toner recovering screw, and 28 is as recycled toner conveying screw.

In FIG. 3, after transfer, the residual toner which is scraped by cleaning member 26, is conveyed from cleaning section 25 utilizing recycled toner recovering screw 27 and is again supplied to development unit 21 utilizing recycled toner conveying screw 28.

Incidentally, the toner recycling mechanism employed in the invention is not limited to FIG. 3.

Listed as a toner recycling system other than the above may be a system in which a toner, which remains on a photoreceptor without being transferred onto a sheet of paper, is recovered employing a blade and then re-conveyed to the development unit. Further, systems may be employed in which the recovered toner is directly returned to the development unit, or fresh toner and recovered toner for recycling are mixed in advance in an intermediate tank and subsequently supplied to the development unit.

Figure 4:
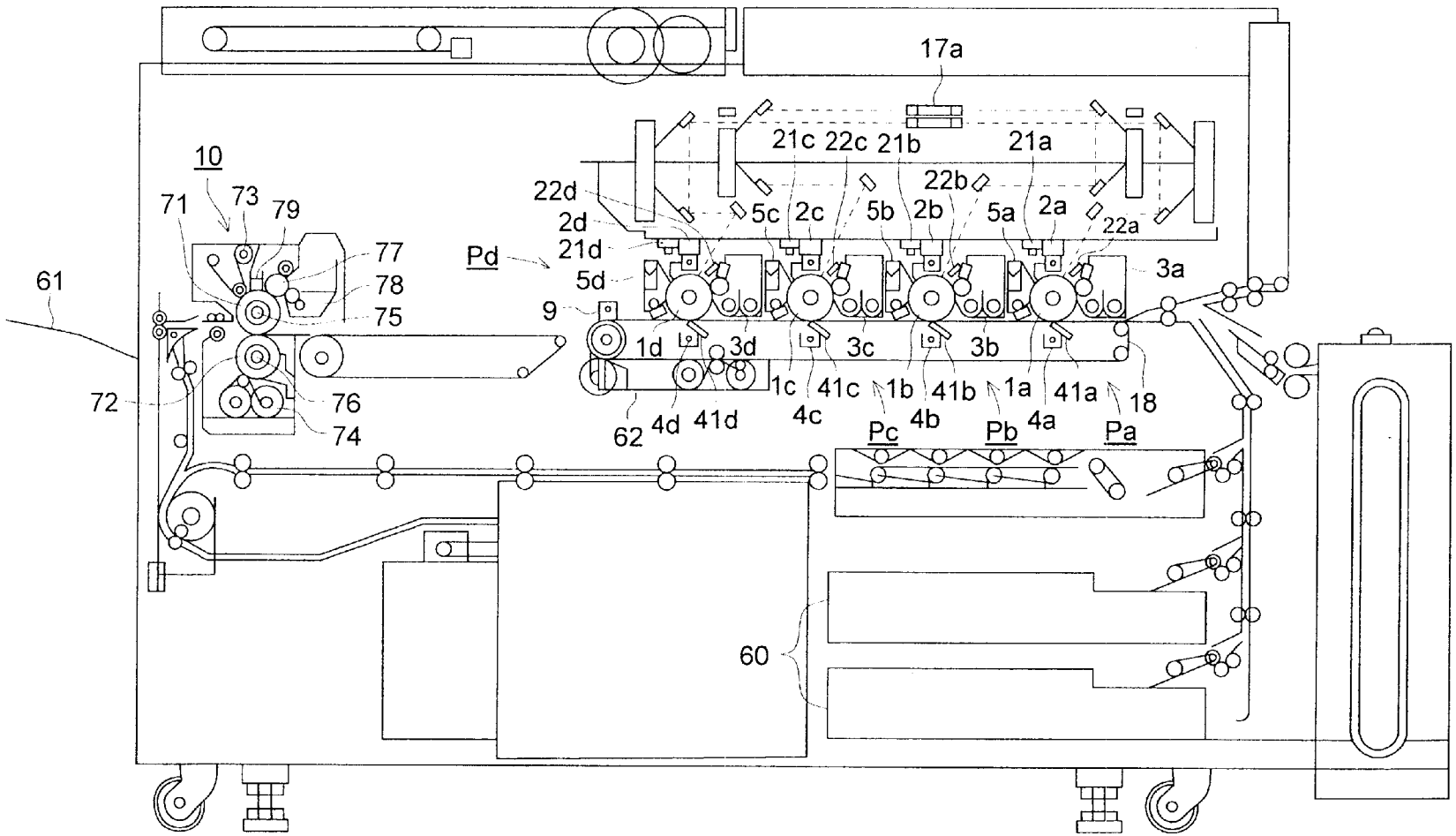
FIG. 4 is a schematic cross-sectional view showing one example of the color electrophotographic image forming apparatus employed in the invention.

An example of the image forming apparatus employed in the invention is shown employing an electrophotographic color image forming apparatus, as shown in FIG. 4.

FIG. 4 is a schematic view showing the structure of one example of the electrophotographic color image forming apparatus employed in the invention.

In the main body of said electrophotographic color image forming apparatus, first, second, third, and fourth image forming sections Pa, Pb, Pc and Pd are arranged in series. Each image forming section is constituted in the same manner and forms visual color images (being toner images) different from each of others.

Image forming sections Pa, Pb, Pc, and Pd each is provided with its own an electrophotographic photoreceptor drum (a photoreceptor) 1*a*, 1*b*, 1*c*, and 1*d*. Each image on each of said electrophotographic photoreceptor drum (hereinafter occasionally referred to as photoreceptor drum) 1*a*, 1*b*, 1*c*, and 1*d*, formed in each of image forming sections Pa, Pb, Pc, and Pd, is transferred onto a recording material (being a transferring member or an image receiving member) which is held on recording material holding body 18 which moves while being adjacent to each image forming section. Further, the image on said recording material is fixed while being heated and pressed, and the resultant recording material is ejected onto tray 61.

The latent image forming section in each image forming section will now be described. In each outer circumference of photoreceptor drums 1*a*, 1*b*, 1*c*, and 1*d*, charge elimination exposure lamps 21*a*, 21*b*, 21*c*, and 21*d*, drum charging units 2*a*, 2*b*, 2*c*, and 2*d*, laser beam exposure unit 17*a*, electric potential sensors 22*a*, 22*b*, 22*c*, and 22*d* are arranged. Each of photoreceptor drums 1*a*, 1*b*, 1*c*, and 1*d*, which have been subjected to charge elimination, employing each of charge elimination exposure lamps 21*a*, 21*b*, 21*c*, and 21*d*, is uniformly charged employing each of drum charging units 2*a*, 2*b*, 2*c* and 2*d* and subsequently is exposed employing laser beam exposure device 17*a*, whereby on each of photoreceptor drums 1*a*, 1*b*, 1*c*, and 1*d*, a color-decomposed electrostatic latent image corresponding to image signals is formed. In the image forming apparatus of the invention, suitably accepted as exposure means, other than said laser beam exposure unit 17*a*, may be any of well known multi-value exposure means in which in the same manner as an LED exposure device, it is possible, in terms of basic image units (pixels), to irradiate light having a plurality of light amount levels except for being turned off.

Said electrostatic latent image on said photoreceptor drum is developed employing a development means and then visualized. Namely, each of said development means is provided with each of development units 3*a*, 3*b*, 3*c*, and 3*d* in which cyan, magenta, yellow, and black developers are filled respectively with the specified amount and develops each respective electrostatic latent image formed on said photoreceptor drums 1*a*, 1*b*, 1*c*, and 1*d*, so as to form visible images (being toner images).

Said transfer section will now be described. A recording material held in recording material cassette 60 is conveyed to recording material holding body 18 via a register roller.

When said recording material holding body 18 starts rotating, said recording material is conveyed on recording material holding body 18 from said register roller. In this instance, image writing signal is turned on, and an image is formed on first electrophotographic photoreceptor 1*a* at optimal timing.

Transfer charging unit 4*a* and transfer pressing member 41*a* are provided under first electrophotographic photoreceptor 1*a*. A toner image on photoreceptor drum 1*a* is transferred onto a recording material in such a manner that a uniform pressing force against said photoreceptor drum is provided by transfer pressing member 41 and an electric field is applied by transfer charging unit 4*a*. At that instance, said recording material is held on recording material holding body 18 utilizing an electrostatic adhesion force and conveyed to second image forming section Pb. Subsequently, the next transfer is carried out. A recording material, onto which toner images, formed by third and fourth image forming sections Pc and Pd, have been transferred in the same manner as above, is subjected to charge elimination, employing separation charging unit (being a separation electrode), is released from recording material holding body 18 due to a decrease in said electrostatic adhesion force, and is conveyed to fixing section (being a fixing unit) 10.

Fixing section 10 is comprised of fixing roller 71, pressure roller 72, heat resistant cleaning members 73 and 74 which clean each of rollers 71 and 72, heaters 75 and 76 which heat each of rollers 71 and 72, oil applying roller 77 which applies releasing oil such as dimethylsilicone onto fixing roller 71, oil container 78 which supplies said oil, and fixing temperature controlling thermister 79.

After transfer, residual toner on photoreceptor drums 1*a,* 1*b,* 1*c,* and 1*d* is removed utilizing photoreceptor cleaning sections 5*a,* 5*b,* 5*c*, and 5*d*, and said photoreceptor drums are prepared for the subsequently formed latent image. Further, residual toner on image receiving member 18 is subjected to charge elimination, employing belt charge elimination unit 12 so as to eliminate electrostatic adhesion force. Thereafter, in the present example, said residual toner is removed by cleaning unit 62 fitted with nonwoven fabric. Employed as cleaning unit 62 are units such as a fur brush, a blade, or combinations thereof.

Figure 5:
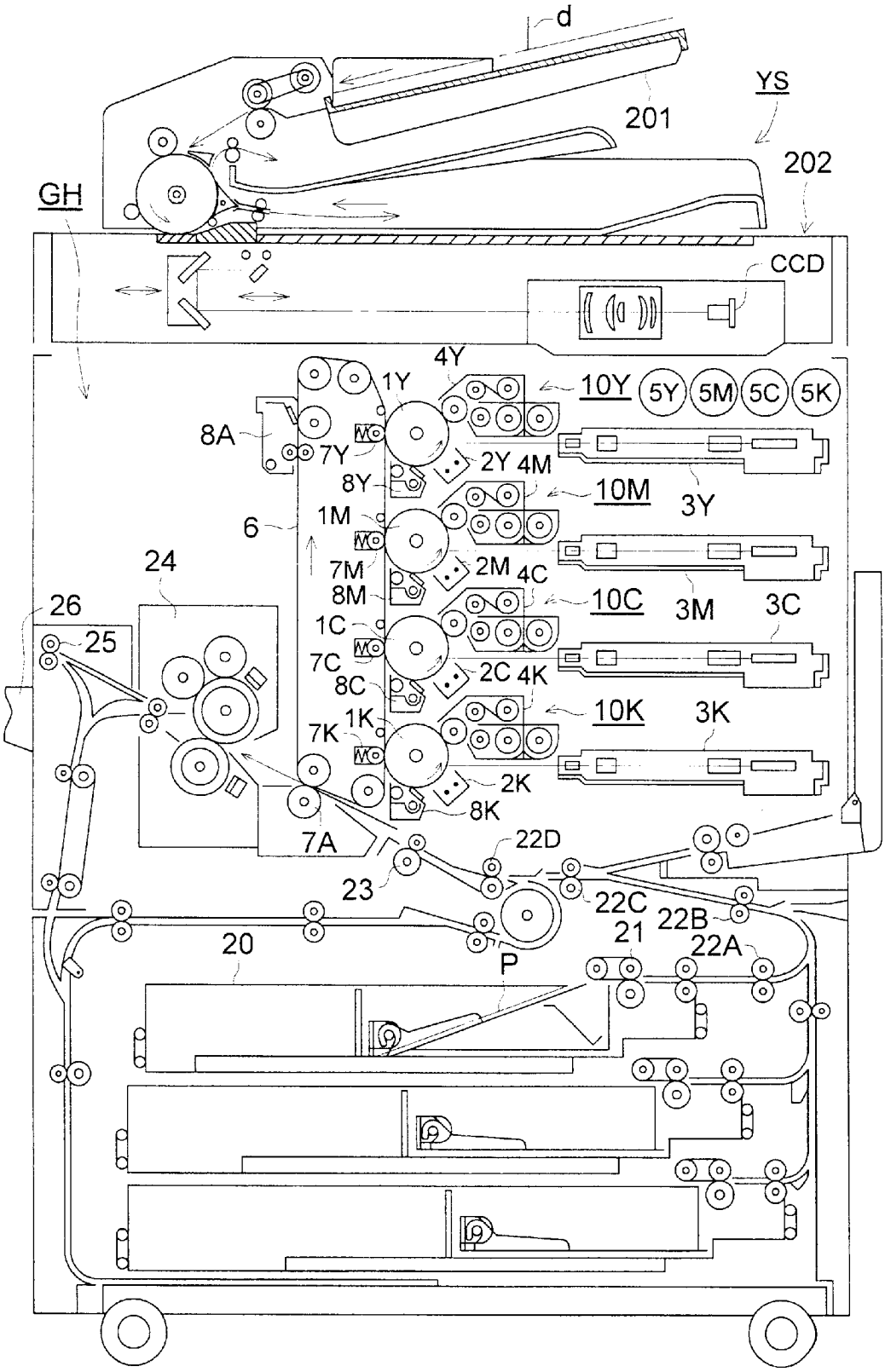
FIG. 5 is a schematic cross-sectional view showing another example of the color electrophotographic image forming apparatus employed in the invention.

Image forming apparatus main body GH, shown in FIG. 5, is one called a tandem type color image forming apparatus, and comprises plural-unit comprising image forming sections 10Y, 10M, 10C, and 10K, belt-shaped intermediate transfer body 6, a fed paper conveying means, and fixing unit 24.

Image forming section 10Y which forms yellow images comprises charging means 2Y which is arranged around photoreceptor 1Y as an electrostatic latent image forming member, image exposure means 3Y, toner development means 4Y, and cleaning means 8Y. Inage forming section 10M, which forms magenta images, comprises photoreceptor 1M as an image forming body, charging means 2M, image exposure means 3M, toner development means 4M, and cleaning means 8M. Image forming section 10C, which forms cyan images, comprises photoreceptor 1C as an image forming body, charging means 2C, image exposure means 3C, toner development means 4C, and cleaning means 8C. Image forming section 10K, which forms black images, comprises photoreceptor 1K as an image forming body, charging means 2K, image exposure means 3K, toner development means 4K, and cleaning means 8K. Charging means 2Y as well as image exposure means 3Y, charging means 2M as well as image exposure means 3M, charging means 2C as well as image exposure means 3C, and charging means 2K as well as image exposure means 3K each constitutes a latent image forming means.

Intermediate image receiving member 6 is a looped belt, and is sustained by a plurality of rollers so as to be rotatable.

Each of color images formed by image forming sections 10Y, 10M, 10C, and 10K is successively transferred (primary transfer) onto rotating intermediate image receiving memeber 6 employing transfer means 7Y, 7M, 7C, and 7K, whereby a superimposed color image is formed.

Image receiving member P, which is housed in paper feeding cassette 20, is fed by paper feeding means 21, and is conveyed to transfer means 7A via paper feeding rollers 22A, 22B, 22C, and resist roller 23, whereby a color image comes into contact with and transferred (secondary transfer) onto image receiving member P. Image receiving member P, onto which said color image has transferred, is subjected to fixing treatment employing fixing unit 24, subsequently held by paper ejecting rollers 25, and ejected onto paper ejecting tray 26 placed in the exterior of the apparatus.

On the other hand, after transferring said color image onto image receiving member P employing transfer means 7A, said image receiving member P is separated from intermediate image receiving member 6. Subsequently, residual toner on intermediate image receiving member 6 is removed.

5Y, 5M, 5C, and 5K each is a toner supplying means which supplies fresh toner to each of toner development means 4Y, 4M, 4C, and 4K.

In the upper part of image forming apparatus main body GH, automatic original document conveying unit 201 as well as image reading unit YS, comprised of original document image scanning exposure unit 202, are arranged. Original document d, placed on the original document platen, is conveyed by a conveying means and images of one side or both sides of said original document are subjected to scanning exposure employing the optical system of original document image scanning exposure unit 202, and is read by an image sensor CCD.

Analogue signals which have been subjected to photoelectric conversion, employing a line image sensor CCD, are subjected to an analogue treatment, A/D conversion, shading correction, and an image compression treatment in the image processing section. Subsequently, resultant signals are transmitted to image writing sections (image exposure means) 3Y, 3M, 3C, and 3K.

Automatic original document conveying unit 201 is provided with an automatic both sided original document conveying means. Said automatic original document conveying unit 201 is capable of continuously and instantly reading the content of a number of original documents d fed from the original document platen and of storing read content in a memory means (electronic RDH function). Accordingly, automatic original document conveying unit 201 is conveniently employed for copying many original documents or for transmitting the content of many original documents d, utilizing a facsimile function.

Used as fixing units (being fixing means), employed in the aforesaid image forming apparatus, may be surf fixing units and pressure contact heat fixing units such as a belt fixing unit, other than commonly employed heating roller fixing units.

As an image forming apparatus represented by FIG. 5, there is one which is commonly called a tandem system. In said tandem system, each of color images is formed on its individual electrostatic latent image forming member (photoreceptor), and each color image is successively transferred onto an intermediate transfer body while superimposing each color image, whereby a multicolor image is formed. Subsequently, the resultant multicolor image is subjected to secondary transfer onto a transfer material, and toner is then fixed. This system results in advantages that printing speed does not differ between the full color image and the monochromatic image.

Further, in said tandem system, development of each color on said electrostatic latent image forming member is carried out independently. As a result, since it is possible to stabilize developability, said tandem system results in advantages which exhibit excellent color reproducibility particularly for forming color images.

As usual, it is known that said image forming method results in good images which are formed on the electrostatic latent image forming member, however, problems occur in which image quality degrades due to the formation of toner repellency (hereinafter occasionally referred simply to as repellency) in fixed images. Said phenomena tend to occur specially at poor ambience such as high temperature and high humidity as well as low temperature and low humidity. The reasons have not yet well clarified. However, it is assumed that since each of color images is successively transferred onto the intermediate image receiving member, said phenomena occur due to variation of charged state of toner between the initially formed toner image and the finally formed toner image. However, it has been proved that such problems are, also, solved by applying the image forming method of the invention to said system.

Further, it has been also proved that, in this system, the effects of the invention is shown more markedly, when the difference between the largest 50% volume particle diameter and the smallest 50% volume particle diameter of the toners, which have different colors from each other, is at most 1 μm and the difference between the largest cumulative 75% volume particle diameter from the largest particle diameter and the smallest cumulative 75% volume particle diameter from the largest particle diameter is at most 1 μm.

EXAMPLES

The invention will now be detailed with reference to examples. However, the invention is not limited to these examples.

Example 1

Added to a 5,000 ml separable flask fitted with a stirring unit, a temperature sensor, a cooling pipe, and a nitrogen gas inlet unit was a solution which had been prepared by dissolving 7.08 g of an anionic surface active agent (sodium dodecylbenzenesulfonate or SDS) in 2,760 g of deionized water. While stirring at 230 rpm, the inner temperature was raised to 80° C. under a nitrogen gas stream. On the other hand, a monomer solution was prepared by dissolving 72.0 g of Exemplified Compound 19) at 80° C. in a monomer composition consisting of 115.1 g of styrene, 42.0 g of n-butyl acrylate, and 10.9 of methacrylic acid. Said heated solution was mix-dispersed employing a mechanical homogenizer, having a circulation channel, whereby emulsified particles, having uniform dispersed particle diameter, were prepared. Subsequently, added was a solution prepared by dissolving 0.84 g of a polymerization initiator (potassium persulfate or KPS) in 200 g of deionized water. The resultant solution was heated and stirred at 80° C. for 3 hours, whereby latex particles were prepared. Thereafter, added was a solution prepared by dissolving 7.73 g of a polymerization initiator (KPS) in 240 ml of deionized water. After 15 minutes, a solution prepared by mixing 383.6 g of styrene, 140.0 g of n-butyl acrylate, 36.4 g of methacrylic acid, and 14.0 g of n-octyl-3-mercaptopropionic acid ester was added dropwise at 80° C. over 120 minutes. After said addition, the resultant mixture was heat-stirred for 60 minutes, and subsequently cooled to 40° C., whereby latex particles were prepared.

The resultant latex particles were designated as Latex 1.

<<Production of Colored Particles>>

(Production of Colored Particles 1Bk)

While stirring, 9.2 g of sodium n-dodecylsulfate was dissolved in 160 ml of deionized water. While stirring, 20 g of Regal 330R (carbon black manufactured by Cabot Co.) was gradually added. Subsequently., the resultant mixture was dispersed employing Clearmix. The particle diameter of said dispersion was determined employing electrophoresis light scattering photometer ELS-800, manufactured by Ohtsuka Denshi Co., resulting in a weight average diameter of 112 nm. The resultant dispersion was designated "Coloring Agent Dispersion 1".

Added to a 5-liter four-necked flask fitted with a temperature sensor, a cooling pipe, a nitrogen gas inlet unit, and a stirring unit were 1,250 g of the aforesaid "Latex 1", 2,000 ml of deionized water, and "Coloring Agent Dispersion 1", and the resultant mixture was stirred. After the temperature was adjusted to 30° C., the pH of the resultant solution was adjusted to 10.0 by adding a 5 mol/L aqueous sodium hydroxide solution. Subsequently, an aqueous solution, prepared by dissolving 52.6 g of magnesium chloride hexahydrate in 72 ml of deionized water, was added while stirring at 30° C. over 5 minutes. After the resultant mixture was set aside for 2 minutes, its temperature was raised to 90° C. over 5 minutes (a temperature elevation rate of 12° C./minute). Under such a state, the particle diameter was determined employing a Coulter Counter TAII. When a volume average particle diameter reached 4.3 μm, particle growth was terminated by adding an aqueous solution prepared by dissolving 115 g of sodium chloride in 700 ml of deionized water. The resultant mixture was further stirred for 8 hours at 85±2° C. so as to undergo salting-out/fusion, and subsequently cooled to 30° C. at a rate of 6° C./minute. Thereafter, the pH was adjusted to 2.0 by adding hydrochloric acid and stirring was then terminated. The resultant colored particles were filtered/washed under the conditions described below and subsequently dried employing a 40° C. airflow, whereby colored particles were prepared. The resultant product was designated as "Colored Particles 1Bk".

(Production of Colored Particles 1Y)

Colored particles were produced in the same manner as Colored Particles 1Bk, except that carbon black was replaced with C.I. Pigment Yellow 185, and the resultant product was designated as "Colored Particles 1Y".

(Production of Colored Particles 1M)

Colored particles were produced in the same manner as Colored Particles 1Bk, except that carbon black was replaced with C.I. Pigment Red 122, and the resultant product was designated as "Colored Particles 1M".

(Production of Colored Particles 1C)

Colored particles were produced in the same manner as Colored Particles 1Bk, except that carbon black was replaced with C.I. Pigment Blue 15:3, and the resultant product was designated as "Colored Particles 1C".

(Production of Colored Particles 2Bk, 3Bk, 4Bk, and 5Bk)

Each of Colored Particles 2Bk through 5Bk were produced in the same manner as Colored Particles 1Bk, except that production conditions were altered as described in Table 1.

(Production of Colored Particles 6Bk Through 8Bk)

Each of Colored Particles 6Bk through 8Bk were produced in the same manner as Colored Particles 1Bk, except that production conditions were set as described in Table 1 and when the volume average particle diameter reached 3.8 μm, particle growth was terminated.

(Production of Colored Particles 9Bk Through 11Bk)

Each of Colored Particles 9Bk through 11Bk were produced in the same manner as Colored Particles 1Bk, except that production conditions were set as described in Table 1, and when the volume average particle diameter reached 5.5 μm, particle growth was terminated.

(Production of Colored Particles 12Bk and 13Bk)

Each of Colored Particles 12Bk and 13Bk was produced in the same manner as Colored Particles 1Bk, except that when the volume average particle diameter reached 1.5 μm and 9.3 μm, respectively, particle growth was terminated.

(Production of Colored Particles 14Bk and 15Bk)

Each of Colored Particles 14Bk and 15Bk was produced in the same manner as Colored Particles 1Bk, except that when the volume average particle diameter reached 5.8 μm and 5.4 μm, respectively, particle growth was terminated.

(Production of Colored Particles 4Y)

Colored particles were produced in the same manner as Colored Particles 4Bk, except that carbon black was replaced with C.I. Pigment Yellow 185, and the resultant product was designated as "Colored Particles 4Y".

(Production of Colored Particles 4Y)

Colored particles were produced in the same manner as Colored Particles 4Bk, except that carbon black was replaced with C.I. Pigment Red 122, and the resultant product was designated as "Colored Particles 4M".

(Production of Colored Particles 4C)

Colored particles were produced in the same manner as Colored Particles 4Bk, except that carbon black was replaced with C.I. Pigment Blue 15:3, and the resultant product was designated as "Colored Particles 4C".

Production conditions of said colored particles are shown in Table 1, and physical properties of each of prepared colored particles are shown in Table 2.

TABLE 1

| | Added | Temperature | Salting-Out/Fusion | |
|---|---|---|---|---|
| Colored Particles No. | Amount of Magnesium Chloride (in g) | Elevation Rate (in ° C./minute) | Composition Temperature | Holding Time (in hour) |
| Colored Particles 1Bk | 52.6 | 12 | 85 ± 2° C. | 8 |
| Colored Particles 1Y | 52.6 | 12 | 85 ± 2° C. | 8 |
| Colored Particles 1M | 52.6 | 12 | 85 ± 2° C. | 8 |
| Colored Particles 1C | 52.6 | 12 | 85 ± 2° C. | 8 |
| Colored Particles 2Bk | 52.6 | 20 | 90 ± 2° C. | 6 |
| Colored Particles 3Bk | 52.6 | 5 | 90 ± 2° C. | 6 |
| Colored Particles 4Bk | 26.3 | 12 | 85 ± 2° C. | 8 |
| Colored Particles 5Bk | 78.9 | 12 | 85 ± 2° C. | 8 |
| Colored Particles 6Bk | 52.6 | 12 | 85 ± 2° C. | 8 |
| Colored Particles 7Bk | 43.3 | 12 | 85 ± 2° C. | 8 |
| Colored Particles 8Bk | 78.9 | 12 | 85 ± 2° C. | 8 |
| Colored Particles 9Bk | 52.6 | 12 | 85 ± 2° C. | 8 |
| Colored Particles 10Bk | 35.5 | 12 | 85 ± 2° C. | 8 |
| Colored Particles 11Bk | 78.9 | 12 | 85 ± 2° C. | 8 |
| Colored Particles 12Bk | 52.6 | 12 | 85 ± 2° C. | 8 |
| Colored Particles 13Bk | 52.6 | 12 | 85 ± 2° C. | 8 |
| Colored Particles 14Bk | 37.1 | 22 | 94 ± 2° C. | 12 |
| Colored Particles 15Bk | 78.9 | 5 | 81 ± 4° C. | 2 |

TABLE 2

| Colored Particles No. | 50% Volume Average Particle Diameter (Dv50) (in. μm) | 50% Number Average particle Diameter (Dp50) (in μm) | Dv50/Dp50 |
|---|---|---|---|
| Colored Particles 1Bk | 4.6 | 4.3 | 1.07 |
| Colored Particles 1Y | 4.6 | 4.3 | 1.07 |
| Colored Particles 1M | 4.7 | 4.4 | 1.07 |
| Colored Particles 1C | 4.6 | 4.3 | 1.07 |
| Colored Particles 2Bk | 4.8 | 4.5 | 1.07 |
| Colored Particles 3Bk | 4.5 | 4.1 | 1.1 |
| Colored Particles 4Bk | 4.6 | 3.7 | 1.24 |
| Colored Particles 4Y | 4.6 | 3.7 | 1.24 |
| Colored Particles 4M | 4.6 | 3.7 | 1.24 |
| Colored Particles 4C | 4.6 | 3.7 | 1.24 |
| Colored Particles 5Bk | 4.7 | 4.3 | 1.09 |
| Colored Particles 6Bk | 3.9 | 3.7 | 1.05 |
| Colored Particles 7Bk | 3.8 | 3.4 | 1.27 |
| Colored Particles 8Bk | 3.9 | 3.8 | 1.03 |
| Colored Particles 9Bk | 5.6 | 5.3 | 1.06 |
| Colored Particles 10Bk | 5.5 | 4.8 | 1.22 |
| Colored Particles 11Bk | 5.7 | 5.4 | 1.06 |
| Colored Particles 12Bk | 1.5 | 1.4 | 1.08 |
| Colored Particles 13Bk | 9.3 | 8.7 | 1.07 |
| Colored Particles 14Bk | 5.8 | 4.8 | 1.21 |
| Colored Particles 15Bk | 5.4 | 5.0 | 1.08 |

TABLE 2-continued

| Colored Particles No. | Cumulative 75% Volume Particle Diameter (Dv75) (in μm) | Cumulative 75% Number Particle Diameter (Dp75) (in μm) | Dv75/Dp75 | Percent by Number of Particles Less Than or Equal to 0.7 × Dp50 |
|---|---|---|---|---|
| Colored Particles 1Bk | 4.1 | 3.7 | 1.11 | 7.8 |
| Colored Particles 1Y | 4.1 | 3.7 | 1.11 | 7.6 |
| Colored Particles 1M | 4.2 | 3.7 | 1.14 | 7.9 |
| Colored Particles 1C | 4.1 | 3.7 | 1.11 | 7.8 |
| Colored Particles 2Bk | 4.2 | 3.7 | 1.14 | 5.5 |
| Colored Particles 3Bk | 4.0 | 3.4 | 1.18 | 8.2 |
| Colored Particles 4Bk | 4.1 | 3.1 | 1.32 | 13.6 |
| Colored Particles 4Y | 4.1 | 3.1 | 1.32 | 13.6 |
| Colored Particles 4M | 4.1 | 3.1 | 1.32 | 13.5 |
| Colored Particles 4C | 4.1 | 3.1 | 1.32 | 13.3 |
| Colored Particles 5Bk | 4.1 | 3.6 | 1.14 | 6.3 |
| Colored Particles 6Bk | 3.3 | 2.8 | 1.18 | 6.8 |
| Colored Particles 7Bk | 3.2 | 2.7 | 1.18 | 11.3 |
| Colored Particles 8Bk | 3.3 | 2.8 | 1.18 | 6.3 |
| Colored Particles 9Bk | 5.1 | 4.5 | 1.13 | 8.5 |
| Colored Particles 10Bk | 4.9 | 4.0 | 1.23 | 12.5 |
| Colored Particles 11Bk | 5.1 | 4.4 | 1.16 | 6.3 |
| Colored Particles 12Bk | 1.2 | 1.0 | 1.16 | 8.5 |

TABLE 2-continued

| | | | | |
|---|---|---|---|---|
| Colored Particles 13Bk | 7.8 | 7.1 | 1.16 | 6.8 |
| Colored Particles 14Bk | 4.9 | 4.19 | 1.17 | 11.0 |
| Colored Partic1es 15Bk | 4.8 | 3.87 | 1.24 | 3.6 |

(Production of Toner Particles)

One weight percent of hydrophobic silica (having a number average primary particle diameter of 12 nm and a degree of hydrophobicity of 68) and hydrophobic titanium oxide (having a number average primary particle diameter of 20 nm and a degree of hydrophobicity of 63) were added to each of the resultant Colored Particles 1Bk through 15Bk, Colored Particles 1Y, 1M, 1C, 4Y, 4M and 4C, and each of said resultant mixtures was mixed employing a Henschel mixer, whereby Toners 1Bk through 15Bk, Toners 1Y through 1C, and Toners 4Y through 4C were produced.

Incidentally, physical properties such as the shape and diameter of each toner were the same as physical property data of the colored particles shown in Table 2.

(Production of Developers)

Each of said toner particles was mixed with a ferrite carrier having a volume average particle diameter of 60 μm, which had been coated with silicone resins, and each of Developers 1Bk through 15Bk, having a toner concentration of 6 percent, Toners 1Y through 1C, and Toner 4Y through 4C was prepared.

<<Production Example of Photoreceptors>>

(Production of Photoreceptor)

Dip-coated onto a 60 mm diameter aluminum drum was a coating solution prepared by dissolving 1.5 weight parts of a polyamide resin (Amilan CM-8000, manufactured by Toray Co.) in a solvent mixture consisting of 90 volume parts of methanol and 10 volume parts of butanol, whereby a 0.23 μm thick interlayer was formed. Subsequently, dip-coated onto said interlayer was a coating solution prepared by mix-dispersing 2 weight parts of titanyl phthalocyanine into a solution prepared by dissolving 0.8 weight part of polyvinyl butyral (Eslex BL-S, manufactured by Sekisui Kagaku Co.) in 100 weight parts of methyl isopropyl ketone, whereby a charge generating layer, having a thickness of 0.2 μm after drying, was formed. Subsequently, dip-coated onto said charge generating layer was a coating solution prepared by dissolving 20 weight parts of BPZ (having a viscosity average molecular weight of 30,000) as polycarbonate and 15 weight parts of a charge transporting material (T-9) in 100 volume parts of 2-dichloroethane, whereby a first charge transporting layer (CTL) was formed.

The average thickness of the charge transporting layer after drying of the resultant photoreceptor was 10 μm, and the difference between the maximum thickness and the minimum thickness of the charge transporting layer of the resultant photoreceptor was 0.5 μm.

Subsequently, the aforementioned photoreceptor as well as the aforementioned developer was provided employed in Sitios 7040 (being a digital copier), manufactured by Konica Corp., and images were formed. The resultant images were evaluated while compared with each other.

<<Evaluation of Image Quality>>

Employed as recording materials were sheets of paper having a ream weight of 55 kg. Images were formed in the longitudinal direction. Further, a Chinese character, 麤, in Ming type/point 9.6 was copied at high temperature and high humidity (32° C. and 85 percent relative humidity). The copied Chinese character, 麤, was copied at the same conditions as above. Said copying was repeated 10 times, and the final one designated as a 10th generation copy. Subsequently, 10 people visually evaluated the resultant Chinese characters and determined the number of generations which was readable as the Chinese character. Then the average of the number of readable generations was determined.

The high quality image, as described in the invention, refers to the image in which said Chinese character is readable enough at the 9th generation copy.

<<Evaluation of Cleaning Properties>>

Further, halftones (having a pixel ratio of 30 percent) were continuously printed onto 100 sheets at low temperature and low humidity (10° C. and 10 percent relative humidity). The presence and absence of insufficient cleaning was determined and evaluated as shown in Table 3.

A: no problems were noticed

B: insufficient cleaning was slightly noticed

C: insufficient cleansing was noticed.

TABLE 3

| Sample No. | Developer | Number of Copied Generation | Cleaning Properties | Remarks |
|---|---|---|---|---|
| 1 | Developer 1Bk | 10th generation | A | Inventive |
| 2 | Developer 2Bk | 10th generation | A | Inventive |
| 3 | Developer 3Bk | 10th generation | A | Inventive |
| 4 | Developer 5Bk | 10th generation | A | Inventive |
| 5 | Developer 6Bk | 10th generation | A | Inventive |
| 6 | Developer 8Bk | 10th generation | A | Inventive |
| 7 | Developer 9Bk | 9th generation | A | Inventive |
| 8 | Developer 11Bk | 10th generation | A | Inventive |
| 9 | Developer 1Bk | 9th generation | A | Inventive |
| 10 | Developer 4Bk | 7th generation | B | Comparative |
| 11 | Developer 7Bk | 7th generation | A | Comparative |
| 12 | Developer 10Bk | 6th generation | A | Comparative |
| 13 | Developer 12Bk | 10th generation | C | Comparative |
| 14 | Developer 13Bk | 4th generation | A | Comparative |
| 15 | Developer 14Bk | 6th generation | A | Comparative |
| 16 | Developer 15Bk | 5th generation | A | Comparative |

Inv.: Invention, Comp.: Comparative Example

Table 3 clearly shows that the samples of the invention exhibit high image quality as well as excellent cleaning properties compared to the comparative examples.

Example 2

<<Evaluation of Color Difference>>

The aforesaid developers and photoreceptor were employed in a copier comprising an intermediate image receiving member, and color difference was evaluated. Full color images were formed as follows, while employing said intermediate image receiving member. An image Y/M/C/Bk development units were arranged around a laminated type photoreceptor. Each of color images was developed on said photoreceptor and was transferred onto said intermediate image receiving member so that a full color image was formed on said intermediate body. The resultant full color image was transferred onto a sheet of paper employed as an image receiving member. Incidentally, a blade cleaning system was employed to clean said photoreceptor. In order to fix the resultant images, a heat fixing unit utilizing a pressure contact system was employed.

Evaluation was carried out as follows. Employing a full color original document having a pixel ratio of 25 percent, 1,000 sheets were printed at high temperature and high humidity of 30° C./80 percent relative humidity. The difference in chroma between the first print and the 1,000th print was evaluated as the color difference.

Namely, the color of the solid image portion of the secondary color (red, blue, and green) was measured employing Macbeth Color-Eye 7000. Subsequently, the color difference was calculated employing CMC (2:1) color difference formula, and was visually evaluated based on the criteria described below.

5 or less: tint variation was not noticed more than 5 to less than 8: slight tint variation was noticed so that flesh tint as well as images of food resulted in a feeling of inappropriateness more than 8 to less than 9: tint variation of red, green and blue was clearly noticed.

When color difference, which had been obtained based on said CMC (2:1) color difference formula was 5 or less, the tint variation of formed images was considered to be in the acceptable level.

Table 4 shows the obtained results.

TABLE 4

| Sample No. | Combination of Developers | Color Difference | Remarks |
|---|---|---|---|
| 17 | Developer 1Bk ~ Developer 1C | 1 | Invention |
| 18 | Developer 4Bk ~ Developer 4C | 7 | Comparative Example |
| 19 | Developer 1Bk ~ Developer 1M Developer 4C | 5 | Invention |

As can clearly be seen from Table 4, the samples of the invention exhibit markedly small color difference.

Example 3

Evaluation was carried out with a color copier comprising an intermediate image receiving member, which employs the image forming system utilizing a tandem system, while deploying developer 1Bk, toners 1Y, 1M, and 1C, and developer 4Bk, toners 4Y, 4M and 4C, which was prepared in Example 1. The average thickness of the charge transporting layer of the photoreceptor was 10 μm, and the difference between the maximum thickness of the charge transfer layer and the minimum thickness of the charge transfer layer of the photoreceptor was 0.5 μm, respectively. As a cleaning system for the photoreceptor, a blade cleaning system was employed.

As a fixing system, a heat fixing apparatus employing a pressure contact system was employed.

Evaluation was carried out as follows. Under high temperature and high humidity ambience of 30° C. and 80 percent relative humidity, an original document having a full color pixel ratio of 25 percent was printed on 100,000 sheets while no image was printed every other sheet. Subsequently, printed sheets were set aside for 4 days under the same ambience as above. Difference in chroma between the color before being set aside and after being set aside was evaluated in terms of color difference. Incidentally, when toner repellency as well as toner scattering occurs frequently, said color difference increases due to color contamination. Said color difference was evaluated in the same manner as Example 2.

Further, the halftone image comprised of 5 percent pixel of each color was visually observed and the roughness of the halftone was evaluated based on the criteria shown below. Said evaluation was performed by 10 people, and rank was determined based on the average. Incidentally, Rank B or better is commercially viable.

Rank A: a uniform image without unevenness

Rank B: presence of slight unevenness

Rank C: presence of several lines of clearly noticeable unevenness

TABLE 5

| Samples No. | Combination of Developers | Maximum Difference of the average volume diameter between toners Dv50 | Dv75 | Color Difference | Roughness of the halftone |
|---|---|---|---|---|---|
| 20 | 1Bk/1Y/1M/1C | 0.2 | 0.1 | 2 | A |
| 21 | 4Bk/4Y/4M/4C | 0.1 | 0.1 | 9 | B |

Effect of the Invention

Image forming methods, which can achieve a high image quality and show a good cleaning ability and a slight color difference between the initial color and the color after a lot of printing, have been provided by the invention.

What is claimed is:

1. An image forming method, comprising the steps of:

forming a latent image on a photoreceptor having an electrically conductive support having thereon a charge generating layer and a charge transporting layer;

developing the latent image with a developer containing a toner so as to form a toner image on the photoreceptor; and transferring the toner image from the photoreceptor onto an image receiving member, wherein the ratio (Dv50/Dp50) of 50% volume particle diameter of the toner (Dv50) to 50% number particle diameter of the toner (Dp50) is within the range of 1.0 to 1.15, the ratio (Dv75/Dp75) of the cumulative 75% volume particle diameter from the largest particle diameter of the toner (Dv75) to the cumulative 75% number particle diameter from the largest particle diameter of the toner (Dp75) is within the range of 1.0 to 1.20 and the number of toner particles having a particle diameter of not larger than 0.7×Dp50 in the toner is at most 10% of the number of all the toner particles in the toner.

2. The image forming method of claim 1, wherein the number of toner particles having a particle diameter of not larger than 0.7×Dp50 in the toner is 5 to 9% of the number of all the toner particles in the toner.

3. The image forming method of claim 2, wherein the 50% volume particle diameter (Dv50) is 2 to 8 μm.

4. The image forming method of claim 3, wherein the 50% number particle diameter (Dp50) is 2 to 7.5 μm.

5. The image forming method of claim 4, wherein the average thickness of the charge transporting layer is 5 to 15 μm.

6. The image forming method of claim 1, wherein the 50% volume particle diameter (Dv50) is 2 to 8 μm.

7. The image forming method of claim 1, wherein the 50% number particle diameter (Dp50) is 2 to 7.5 μm.

8. The image forming method of claim 1, wherein the average thickness of the charge transporting layer is 5 to 15 μm.

9. An image forming method comprising the steps of:

forming a latent image on a photoreceptor having an electrically conductive support having thereon a charge generating layer and a charge transporting layer;

developing the latent image with a developer containing toner so as to form a toner image on the photoreceptor;

transferring the toner image from the photoreceptor onto an intermediate image receiving member; and transferring the toner image from the intermadiate image receiving member onto an image receiving member, wherein the ratio (Dv50/Dp50) of 50% volume particle diameter of the toner (Dv50) to 50% number particle diameter of the toner (Dp50) is within the range of 1.0 to 1.15, the ratio (Dv75/Dp75) of the cumulative 75% volume particle diameter from the largest particle diameter of the toner (Dv75) to the cumulative 75% number particle diameter from the largest particle diameter (Dp75) is within the range of 1.0 to 1.20 and the number of toner particles having a particle diameter of not more than 0.7×Dp50 in the toner is at most 10% of the number of all the toner particles in the toner.

10. A color image forming method, comprising the steps of:

forming plural latent images separately on plural photoreceptors, each of which comprises an electrically conductive support having thereon a charge generating layer and a charge transporting layer;

developing the plural latent images with plural different color developers so as to form plural toner images on the plural photoreceptors, the plural different color developers containing plural different color toners from each other;

superimposing the plural different color toner images by transferring the plural different color toner images one after on other from the plural photoreceptors onto an intermediate image receiving member so that a color image is formed on the intermediate image receiving member; and transferring the color image is formed from the intermediate image receiving member onto an image receiving member, wherein the following relations are satisfied in at least one of the color toners: the ratio (Dv50/Dp50) of 50% volume particle diameter of the toner (Dv50) to 50% number particle diameter of at least one of the toners (Dp50) is within the range of 1.0 to 1.15, the ratio (Dv75/Dp75) of the cumulative 75% volume particle diameter from the largest particle diameter (Dv75) to the cumulative 75% number particle diameter from the largest particle diameter (Dp75) is within the range of 1.0 to 1.20 and the number of toner particles having a particle diameter of not larger than 0.7×Dp50 in the toner is at most 10% of the number of all the toner particles in the toner.

11. The image forming method of claim 10, wherein, in the color toners contained in the plural color developers, the difference between the largest 50% volume particle diameter and the smallest 50% volume particle diameter is at most 1 μm, and the difference between the largest cumulative 75% volume particle diameter from the largest particle diameter and the smallest cumulative 75% volume particle diameter from the largest particle diameter is at most 1 μm.

12. An electrostatic image developing toner, wherein the ratio (Dv50/Dp50) of 50% volume particle diameter of the toner (Dv50), to 50% number particle diameter of the toner (Dp50), is within the range of 1.0 to 1.15, the ratio (Dv75/Dp75) of the cumulative 75% volume particle diameter from the largest particle diameter of the toner (Dv75) to the cumulative 75% number particle diameter from the largest particle diameter of the toner (Dp75) is within the range of 1.0 to 1.20 and the number of toner particles having a particle diameter of not larger than 0.7×Dp50 in the toner is at most 10% of the number of all the toner particles in the toner.

* * * * *

UNITED STATES PATENT AND TRADEMARK OFFICE

CERTIFICATE OF CORRECTION

PATENT NO. : 6,689,522 B2
DATED : February 10, 2004
INVENTOR(S) : Yamazaki et al.

It is certified that error appears in the above-identified patent and that said Letters Patent is hereby corrected as shown below:

Title page,
Item [73], Assignee, please delete "[73] Assignee: Konica Minolta Technosearch Co., Ltd." and insert therefore -- [73] Assignee: Konica Corporation --.

Signed and Sealed this

Twenty-second Day of June, 2004

JON W. DUDAS
*Acting Director of the United States Patent and Trademark Office*